US010472790B2

(12) United States Patent
Osawa et al.

(10) Patent No.: US 10,472,790 B2
(45) Date of Patent: Nov. 12, 2019

(54) JET GROUTING METHOD, GROUND IMPROVEMENT BODY, AND GROUND IMPROVEMENT STRUCTURE

(71) Applicants: NITTO TECHNOLOGY GROUP Inc., Tokyo (JP); N.I.T. Inc., Tokyo (JP)

(72) Inventors: Kazumi Osawa, Tokyo (JP); Takashi Shinsaka, Tokyo (JP)

(73) Assignees: NITTO TECHNOLOGY GROUP Inc., Tokyo (JP); N.I.T. INC., Tokyo (JP)

( * ) Notice: Subject to any disclaimer, the term of this patent is extended or adjusted under 35 U.S.C. 154(b) by 0 days.

(21) Appl. No.: 15/750,539

(22) PCT Filed: Aug. 1, 2016

(86) PCT No.: PCT/JP2016/072568

§ 371 (c)(1),
(2) Date: Feb. 6, 2018

(87) PCT Pub. No.: WO2017/022732

PCT Pub. Date: Feb. 9, 2017

(65) Prior Publication Data

US 2018/0238011 A1 Aug. 23, 2018

(30) Foreign Application Priority Data

Aug. 6, 2015 (JP) ..... 2015-156519
Mar. 4, 2016 (JP) ..... 2016-042809

(51) Int. Cl.
*E02D 3/12* (2006.01)
*E02D 5/46* (2006.01)
(Continued)

(52) U.S. Cl.
CPC ..... *E02D 3/12* (2013.01); *E02D 3/054* (2013.01); *E02D 3/126* (2013.01); *E02D 5/46* (2013.01); *E02D 5/66* (2013.01)

(58) Field of Classification Search
CPC ..... E02D 3/126
(Continued)

(56) References Cited

U.S. PATENT DOCUMENTS 5,013,185 A * 5/1991 Taki ..... E02D 3/126 405/128.45
5,026,216 A * 6/1991 Koiwa ..... E02D 3/12 405/233
(Continued)

FOREIGN PATENT DOCUMENTS

JP 2004169304 A 6/2004
JP 2012062626 A 3/2012
(Continued)

*Primary Examiner* — Frederick L Lagman
(74) *Attorney, Agent, or Firm* — Browdy and Neimark, PLLC

(57) ABSTRACT

A jet grouting method is capable of reducing an unnecessary portion (redundant portion) exceeding an effective wall thickness without narrowing a construction pitch, and capable of allowing easy mechanical control. A ground improvement structure including a plurality of ground improvement bodies is constructed through use of the jet grouting method. Each of the ground improvement bodies is constructed so as to have a sectional shape formed by a combination of different kinds of fan shapes having different radiuses. The sectional shape of the ground improvement body is a combination of at least two kinds of fan shapes. One of the kinds of the fan shapes corresponds to a fan shape with a smaller radius, and the other corresponds to a fan shape with a larger radius. The sectional shape of the improvement body has a minimum diameter portion formed of the fan shapes with the smallest radius and a maximum diameter portion formed of the fan shapes with the largest radius. When designing the ground improvement body, a central angle is determined from a fan shape having the smallest radius with respect to the effective wall thickness. When constructing the ground improvement body, a diameter thereof is controlled by stepwisely changing a rotation speed of the injection rod. At that time, a soil breaking achieved by an improving material injected at high pressure
(Continued)

is monitored so as to check the diameter of the ground improvement body and the effective thickness thereof.

5 Claims, 26 Drawing Sheets

(51) Int. Cl.
*E02D 3/054* (2006.01)
*E02D 5/66* (2006.01)

(58) Field of Classification Search
USPC ..... 405/269
See application file for complete search history.

(56) References Cited

U.S. PATENT DOCUMENTS 5,503,501 A * 4/1996 Kunito ..... E02D 3/12
405/237
5,816,748 A * 10/1998 Kleiser ..... E02D 31/006
405/268
6,357,968 B1 * 3/2002 Dwyer ..... E02D 3/12
405/128.1

FOREIGN PATENT DOCUMENTS

JP 2012097550 A 5/2012
JP 2012107463 A 6/2012
JP 2013002044 A 1/2013
JP 2015110873 A 6/2015
WO WO 92/21825 * 12/1992

* cited by examiner

[FIG. 1]
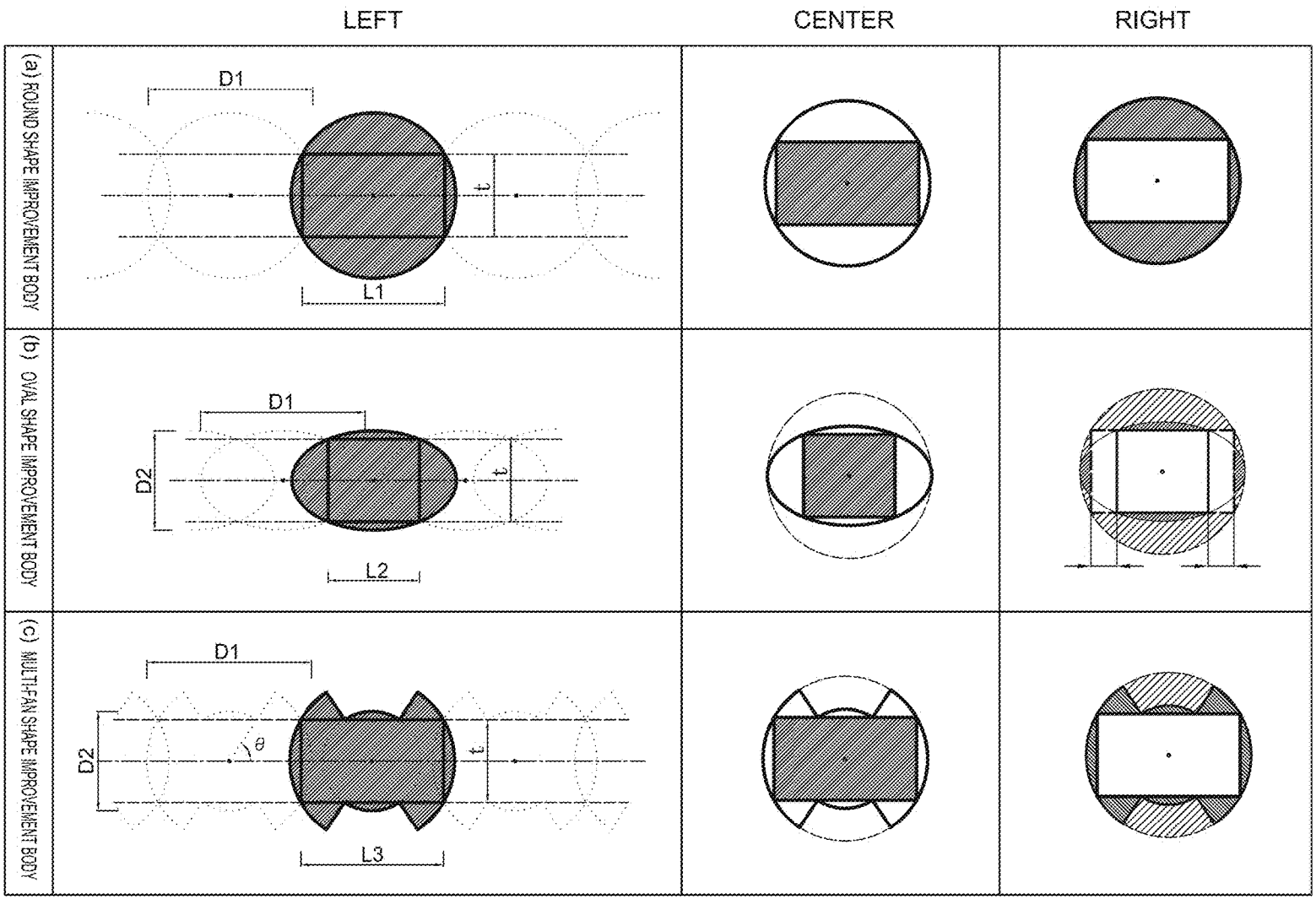

[FIG. 2]
(a)
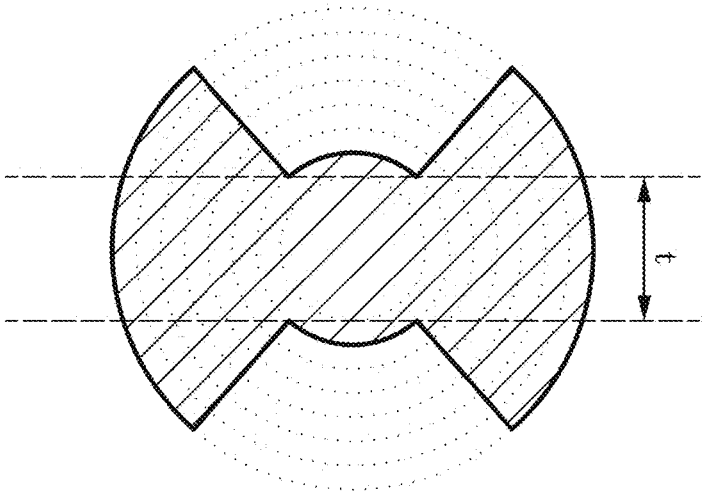
(b)
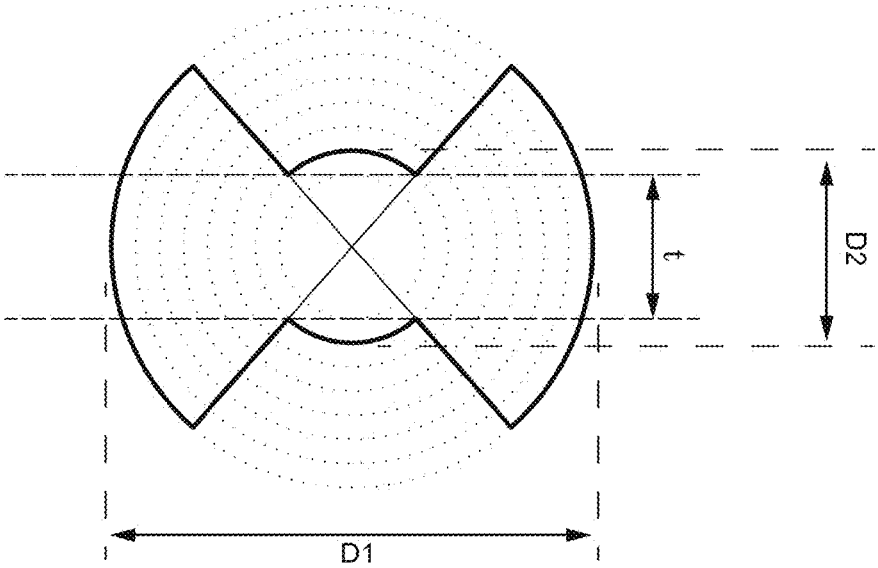

[FIG. 3]
(a)
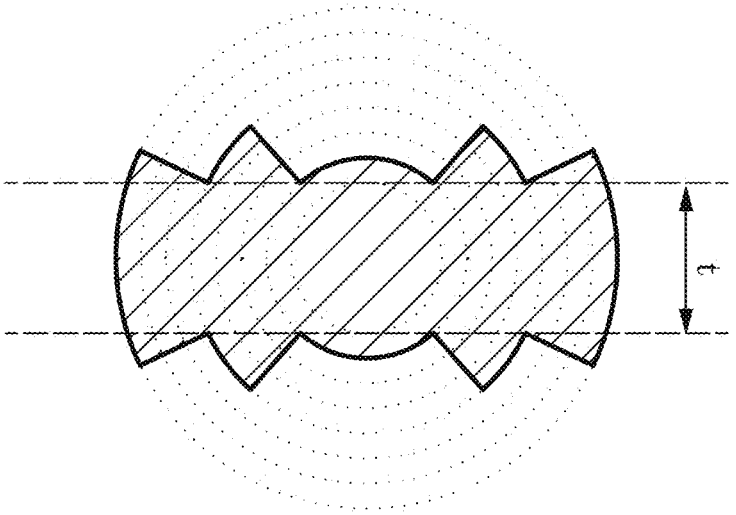
(b)
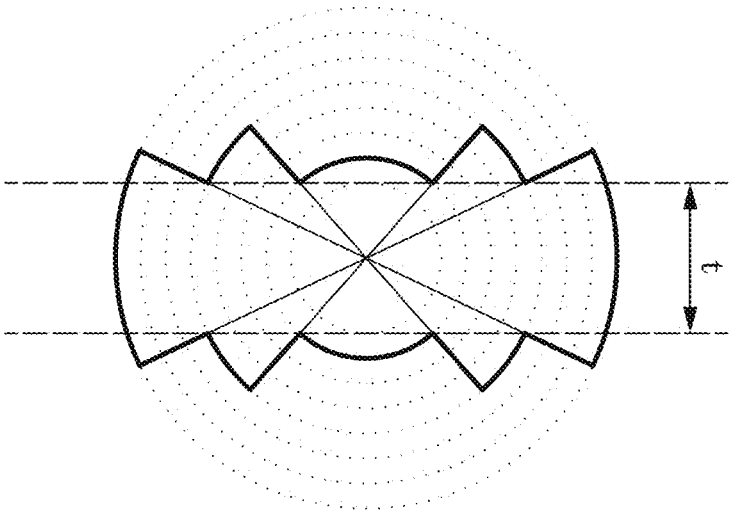

[FIG. 4]
(a)
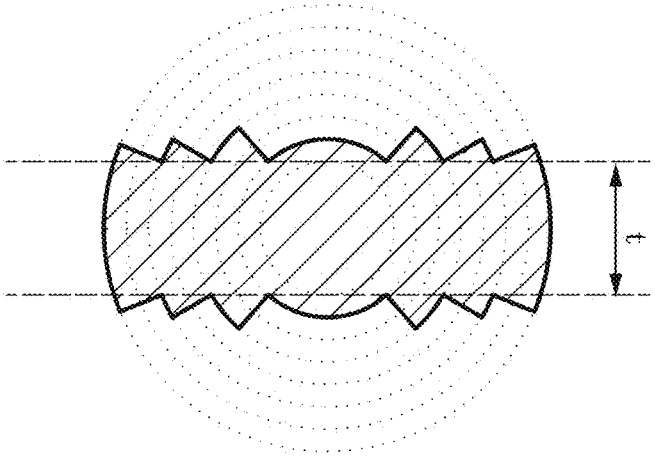
(b)
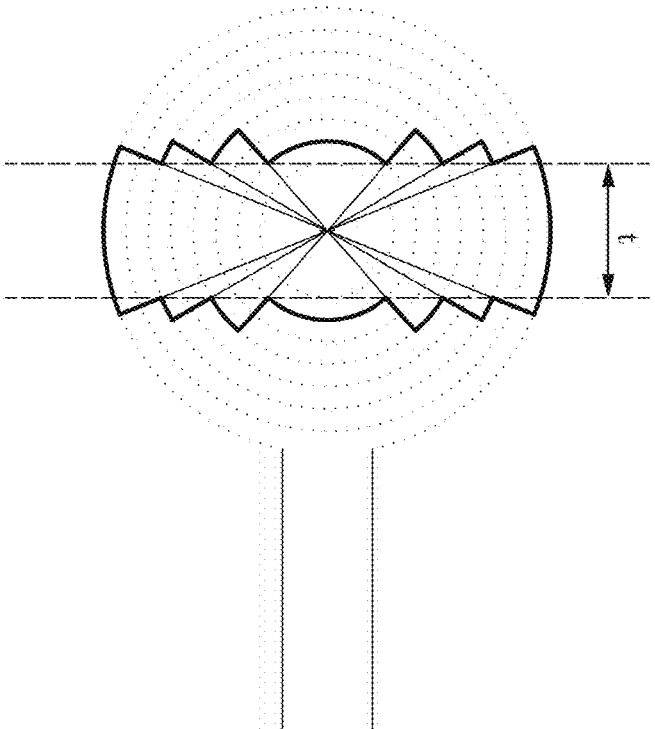

[FIG. 5]
(a)
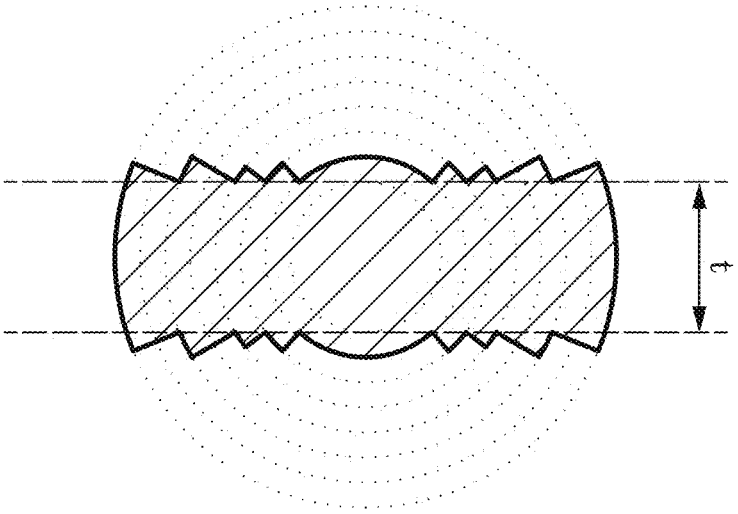
(b)
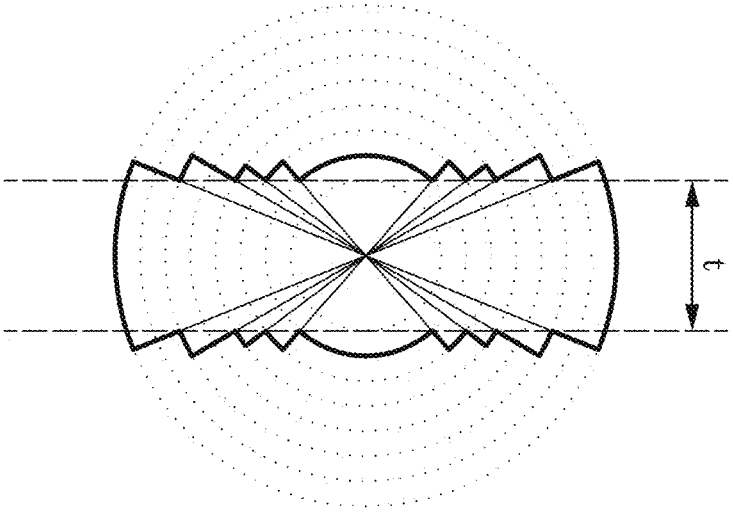

[FIG. 6]

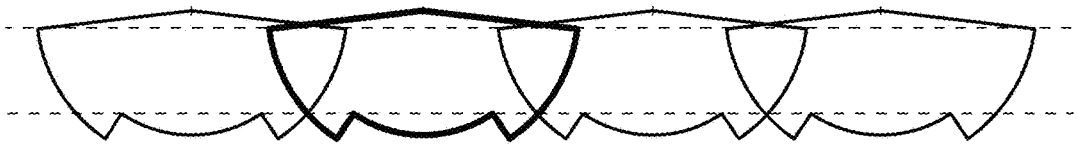

(a) Improvement bodies in a case where the jet grouting cannot be carried out from the top of a wall portion with an effective wall thickness.

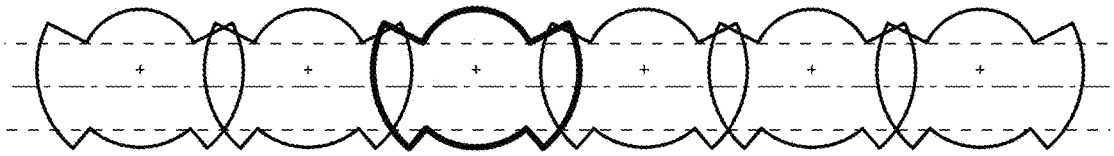

(b) Improvement bodies in a case where the jet grouting cannot be carried out along with the center line of a wall portion with an effective wall thickness.

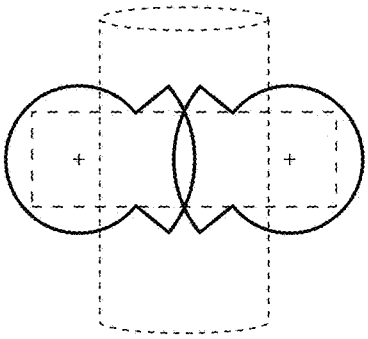

(c) Improvement bodies in a case where an underground pipe or the like is present.

[FIG. 7]
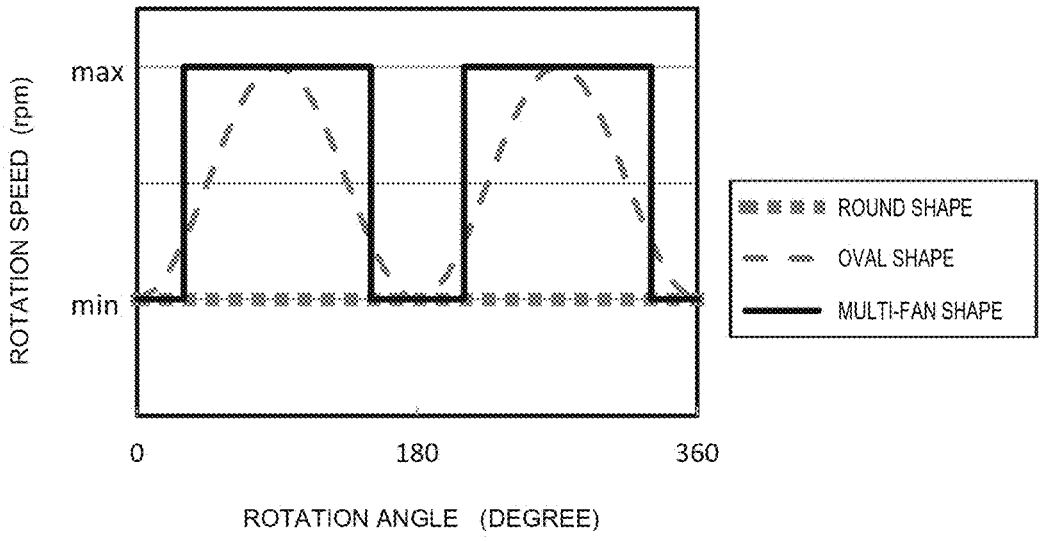

[FIG. 8]
(a)
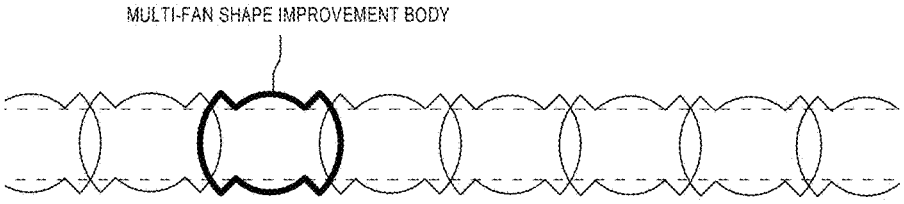
(b)
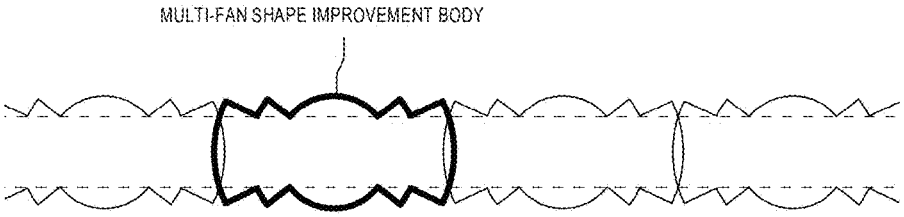
(c)
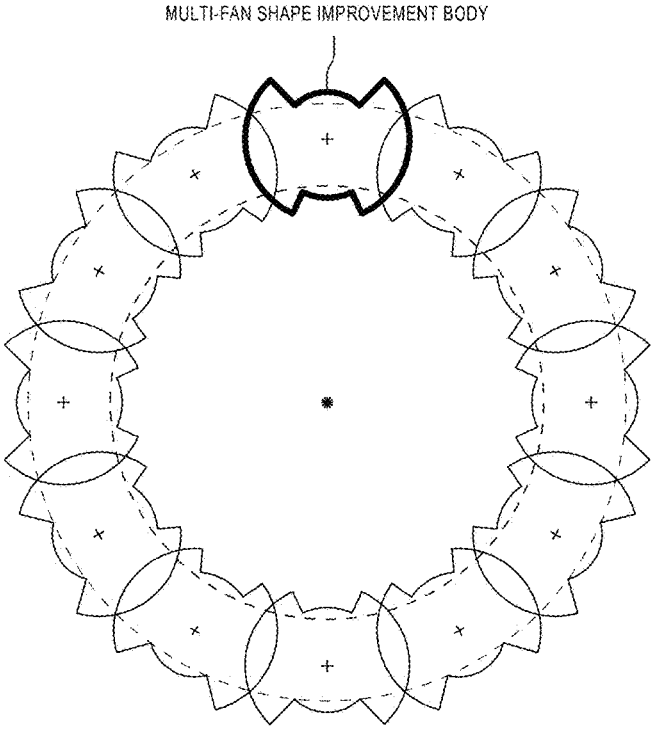

[FIG. 9]
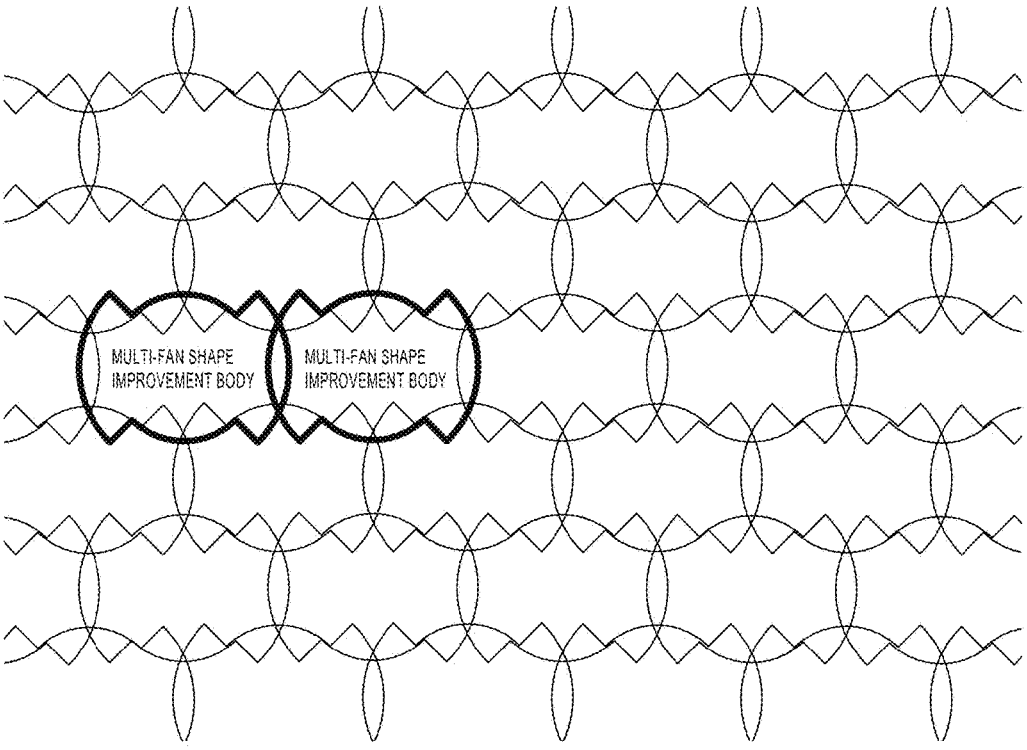

[FIG. 10]
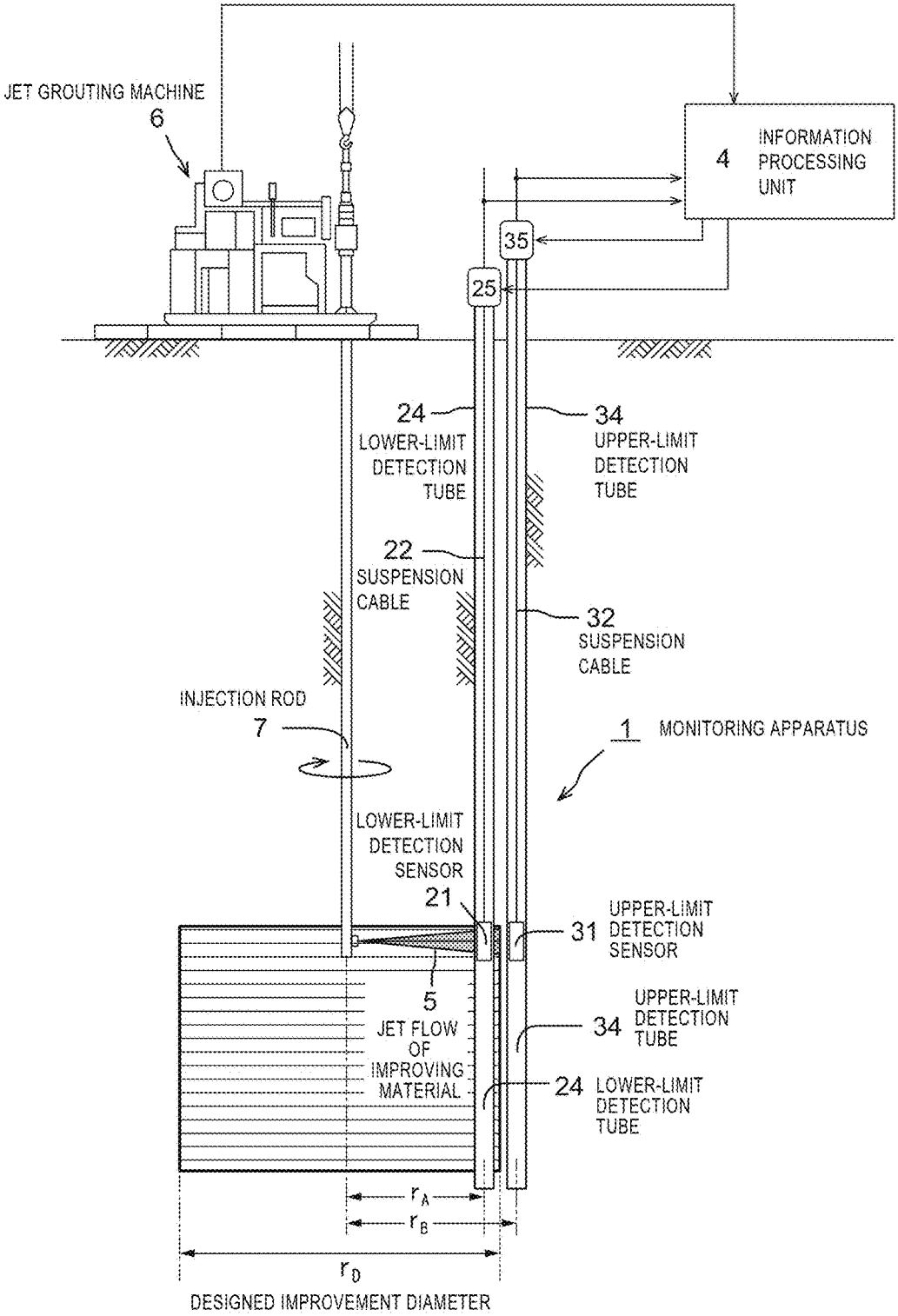

[FIG. 11]

COMPARATIVE EXAMPLE 1 / ROUND SHAPE IMPROVEMENT BODY

*C.I.C.: COLUMN-IN-COLUMN
The c.i.c. risk becomes higher as value becomes closer to 0, and the c.i.c. occurs with negative value.

| SECTIONAL SHAPE | LARGE DIAMETER D1 | SMALL DIAMETER COEFFICIENT b | SMALL DIAMETER D2=b•D1 | WALL THICKNESS COEFFICIENT a | WALL THICKNESS t=a•D1 | PITCH L | PITCH RATIO L/D1 | NUMBER RATIO OF IMPROVEMENT BODIES | SECTIONAL AREA OF IMPROVEMENT BODY Ajg | EFFECTIVE SECTIONAL AREA OF BODY Aw | RATIO OF EFFECTIVE SECTIONAL AREA Ajg/Aw | REDUNDANT AMOUNT Ajg−Aw | REDUNDANT RATIO (Ajg−Aw)/Aw | C.I.C.* D1/2−L |
|---|---|---|---|---|---|---|---|---|---|---|---|---|---|---|
| ROUND | 1.000 | ——— | ——— | 0.100 | 0.100 | 0.995 | 0.995 | 1.000 | 0.785 | 0.099 | 7.894 | 0.686 | 6.894 | 0.495 |
| ROUND | 1.000 | ——— | ——— | 0.150 | 0.150 | 0.989 | 0.989 | 1.000 | 0.785 | 0.148 | 5.296 | 0.637 | 4.296 | 0.489 |
| ROUND | 1.000 | ——— | ——— | 0.200 | 0.200 | 0.980 | 0.980 | 1.000 | 0.785 | 0.196 | 4.008 | 0.589 | 3.008 | 0.480 |
| ROUND | 1.000 | ——— | ——— | 0.300 | 0.300 | 0.954 | 0.954 | 1.000 | 0.785 | 0.286 | 2.744 | 0.499 | 1.744 | 0.454 |
| ROUND | 1.000 | ——— | ——— | 0.400 | 0.400 | 0.917 | 0.917 | 1.000 | 0.785 | 0.367 | 2.142 | 0.419 | 1.142 | 0.417 |
| ROUND | 1.000 | ——— | ——— | 0.500 | 0.500 | 0.866 | 0.866 | 1.000 | 0.785 | 0.433 | 1.814 | 0.352 | 0.814 | 0.366 |
| ROUND | 1.000 | ——— | ——— | 0.600 | 0.600 | 0.800 | 0.800 | 1.000 | 0.785 | 0.480 | 1.636 | 0.305 | 0.636 | 0.300 |
| ROUND | 1.000 | ——— | ——— | 0.700 | 0.700 | 0.714 | 0.714 | 1.000 | 0.785 | 0.500 | 1.571 | 0.285 | 0.571 | 0.214 |
| ROUND | 1.000 | ——— | ——— | 0.800 | 0.800 | 0.600 | 0.600 | 1.000 | 0.785 | 0.480 | 1.636 | 0.305 | 0.636 | 0.100 |

[FIG. 12]

COMPARATIVE EXAMPLE 2 ／ OVAL SHAPE IMPROVEMENT BODY

*C.I.C.: COLUMN-IN-COLUMN
The c.i.c. risk becomes higher as value becomes closer to 0, and the c.i.c. occurs with negative value.

| SECTIONAL SHAPE | LARGE DIAMETER D1 | SMALL DIAMETER COEFFICIENT b | SMALL DIAMETER D2=b•D1 | WALL THICKNESS COEFFICIENT a | WALL THICKNESS t=a•D1 | PITCH L | PITCH RATIO L/D1 | NUMBER RATIO OF IMPROVEMENT BODIES | SECTIONAL AREA OF IMPROVEMENT BODY Ajg | EFFECTIVE SECTIONAL AREA OF BODY Aw | RATIO OF EFFECTIVE SECTIONAL AREA Ajg/Aw | REDUNDANT AMOUNT Ajg−Aw | REDUNDANT RATIO (Ajg−Aw)/Aw | C.I.C.* D1/2−L | a/b | b/a |
|---|---|---|---|---|---|---|---|---|---|---|---|---|---|---|---|---|
| OVAL(0.8) | 1.000 | 0.800 | 0.800 | 0.100 | 0.100 | 0.992 | 0.992 | 1.003 | 0.628 | 0.099 | 6.333 | 0.529 | 5.333 | 0.492 | 0.125 | 8.000 |
| OVAL(0.8) | 1.000 | 0.800 | 0.800 | 0.150 | 0.150 | 0.982 | 0.982 | 1.007 | 0.628 | 0.147 | 4.264 | 0.481 | 3.264 | 0.482 | 0.188 | 5.333 |
| OVAL(0.8) | 1.000 | 0.800 | 0.800 | 0.200 | 0.200 | 0.968 | 0.968 | 1.012 | 0.628 | 0.194 | 3.245 | 0.435 | 2.245 | 0.468 | 0.250 | 4.000 |
| OVAL(0.8) | 1.000 | 0.800 | 0.800 | 0.300 | 0.300 | 0.927 | 0.927 | 1.029 | 0.628 | 0.278 | 2.259 | 0.350 | 1.259 | 0.427 | 0.375 | 2.667 |
| OVAL(0.8) | 1.000 | 0.800 | 0.800 | 0.400 | 0.400 | 0.866 | 0.866 | 1.058 | 0.628 | 0.346 | 1.814 | 0.282 | 0.814 | 0.366 | 0.500 | 2.000 |
| OVAL(0.8) | 1.000 | 0.800 | 0.800 | 0.500 | 0.500 | 0.781 | 0.781 | 1.109 | 0.628 | 0.390 | 1.610 | 0.238 | 0.610 | 0.281 | 0.625 | 1.600 |
| OVAL(0.8) | 1.000 | 0.800 | 0.800 | 0.600 | 0.600 | 0.661 | 0.661 | 1.209 | 0.628 | 0.397 | 1.583 | 0.231 | 0.583 | 0.161 | 0.750 | 1.333 |
| OVAL(0.8) | 1.000 | 0.800 | 0.800 | 0.700 | 0.700 | 0.484 | 0.484 | 1.475 | 0.628 | 0.339 | 1.854 | 0.289 | | −0.016 | 0.875 | 1.143 |
| OVAL(0.6) | 1.000 | 0.600 | 0.600 | 0.100 | 0.100 | 0.986 | 0.986 | 1.009 | 0.471 | 0.099 | 4.779 | 0.373 | 3.779 | 0.486 | 0.167 | 6.000 |
| OVAL(0.6) | 1.000 | 0.600 | 0.600 | 0.150 | 0.150 | 0.968 | 0.968 | 1.021 | 0.471 | 0.145 | 3.245 | 0.326 | 2.245 | 0.468 | 0.250 | 4.000 |
| OVAL(0.6) | 1.000 | 0.600 | 0.600 | 0.200 | 0.200 | 0.943 | 0.943 | 1.039 | 0.471 | 0.189 | 2.499 | 0.283 | 1.499 | 0.443 | 0.333 | 3.000 |
| OVAL(0.6) | 1.000 | 0.600 | 0.600 | 0.300 | 0.300 | 0.866 | 0.866 | 1.102 | 0.471 | 0.260 | 1.814 | 0.211 | 0.814 | 0.366 | 0.500 | 2.000 |
| OVAL(0.6) | 1.000 | 0.600 | 0.600 | 0.400 | 0.400 | 0.745 | 0.745 | 1.230 | 0.471 | 0.298 | 1.581 | 0.173 | 0.581 | 0.245 | 0.667 | 1.500 |
| OVAL(0.6) | 1.000 | 0.600 | 0.600 | 0.500 | 0.500 | 0.553 | 0.553 | 1.567 | 0.471 | 0.276 | 1.705 | 0.195 | 0.705 | 0.053 | 0.833 | 1.200 |
| OVAL(0.4) | 1.000 | 0.400 | 0.400 | 0.100 | 0.100 | 0.968 | 0.968 | 1.028 | 0.314 | 0.097 | 3.245 | 0.217 | 2.245 | 0.468 | 0.250 | 4.000 |
| OVAL(0.4) | 1.000 | 0.400 | 0.400 | 0.150 | 0.150 | 0.927 | 0.927 | 1.067 | 0.314 | 0.139 | 2.259 | 0.175 | 1.259 | 0.427 | 0.375 | 2.667 |
| OVAL(0.4) | 1.000 | 0.400 | 0.400 | 0.200 | 0.200 | 0.866 | 0.866 | 1.131 | 0.314 | 0.173 | 1.814 | 0.141 | 0.814 | 0.366 | 0.500 | 2.000 |
| OVAL(0.4) | 1.000 | 0.400 | 0.400 | 0.300 | 0.300 | 0.661 | 0.661 | 1.442 | 0.314 | 0.198 | 1.583 | 0.116 | 0.583 | 0.161 | 0.750 | 1.333 |
| OVAL(0.3) | 1.000 | 0.300 | 0.300 | 0.100 | 0.100 | 0.943 | 0.943 | 1.055 | 0.236 | 0.094 | 2.499 | 0.141 | 1.499 | 0.443 | 0.333 | 3.000 |
| OVAL(0.3) | 1.000 | 0.300 | 0.300 | 0.150 | 0.150 | 0.866 | 0.866 | 1.142 | 0.236 | 0.130 | 1.814 | 0.106 | 0.814 | 0.366 | 0.500 | 2.000 |
| OVAL(0.3) | 1.000 | 0.300 | 0.300 | 0.200 | 0.200 | 0.745 | 0.745 | 1.315 | 0.236 | 0.149 | 1.581 | 0.087 | 0.581 | 0.245 | 0.667 | 1.500 |
| OVAL(0.2) | 1.000 | 0.200 | 0.200 | 0.100 | 0.100 | 0.866 | 0.866 | 1.149 | 0.157 | 0.087 | 1.814 | 0.070 | 0.814 | 0.366 | 0.500 | 2.000 |
| OVAL(0.2) | 1.000 | 0.200 | 0.200 | 0.150 | 0.150 | 0.661 | 0.661 | 1.495 | 0.157 | 0.099 | 1.583 | 0.058 | 0.583 | 0.161 | 0.750 | 1.333 |

[FIG. 13A]

EXAMPLE / MULTI-FAN SHAPE IMPROVEMENT BODY

*C.I.C.: COLUMN-IN-COLUMN
The c.i.c. risk becomes higher as value becomes closer to 0, and the c.i.c. occurs with negative value.

| SECTIONAL SHAPE | LARGE DIAMETER D1 | SMALL DIAMETER COEFFICIENT b | SMALL DIAMETER D2=b·D1 | WALL THICKNESS COEFFICIENT a | WALL THICKNESS t=a·D1 | PITCH L | PITCH RATIO L/D1 | NUMBER RATIO OF IMPROVEMENT BODIES | SECTIONAL AREA OF IMPROVEMENT BODY Ajg | EFFECTIVE SECTIONAL AREA OF BODY Aw | RATIO OF EFFECTIVE SECTIONAL AREA Ajg/Aw | REDUNDANT AMOUNT Ajg−Aw | REDUNDANT RATIO (Ajg−Aw)/Aw | C.I.C.* D1/2−L | a/b | b/a |
|---|---|---|---|---|---|---|---|---|---|---|---|---|---|---|---|---|
| MULTI-FAN (0.8) | 1.000 | 0.800 | 0.800 | 0.100 | 0.100 | 0.995 | 0.995 | 1.000 | 0.525 | 0.099 | 5.279 | 0.426 | 4.279 | 0.495 | 0.125 | 8.000 |
| MULTI-FAN (0.8) | 1.000 | 0.800 | 0.800 | 0.150 | 0.150 | 0.989 | 0.989 | 1.000 | 0.537 | 0.148 | 3.618 | 0.388 | 2.618 | 0.489 | 0.188 | 5.333 |
| MULTI-FAN (0.8) | 1.000 | 0.800 | 0.800 | 0.200 | 0.200 | 0.980 | 0.980 | 1.000 | 0.548 | 0.196 | 2.797 | 0.352 | 1.797 | 0.480 | 0.250 | 4.000 |
| MULTI-FAN (0.8) | 1.000 | 0.800 | 0.800 | 0.300 | 0.300 | 0.954 | 0.954 | 1.000 | 0.572 | 0.286 | 1.998 | 0.286 | 0.998 | 0.454 | 0.375 | 2.667 |
| MULTI-FAN (0.8) | 1.000 | 0.800 | 0.800 | 0.400 | 0.400 | 0.917 | 0.917 | 1.000 | 0.597 | 0.367 | 1.628 | 0.230 | 0.628 | 0.417 | 0.500 | 2.000 |
| MULTI-FAN (0.8) | 1.000 | 0.800 | 0.800 | 0.500 | 0.500 | 0.866 | 0.866 | 1.000 | 0.624 | 0.433 | 1.441 | 0.191 | 0.441 | 0.366 | 0.625 | 1.600 |
| MULTI-FAN (0.8) | 1.000 | 0.800 | 0.800 | 0.600 | 0.600 | 0.800 | 0.800 | 1.000 | 0.655 | 0.480 | 1.365 | 0.175 | 0.365 | 0.300 | 0.750 | 1.333 |
| MULTI-FAN (0.8) | 1.000 | 0.800 | 0.800 | 0.700 | 0.700 | 0.714 | 0.714 | 1.000 | 0.694 | 0.500 | 1.389 | 0.195 | 0.389 | 0.214 | 0.875 | 1.143 |
| MULTI-FAN (0.6) | 1.000 | 0.600 | 0.600 | 0.100 | 0.100 | 0.995 | 0.995 | 1.000 | 0.336 | 0.099 | 3.380 | 0.237 | 2.380 | 0.495 | 0.167 | 6.000 |
| MULTI-FAN (0.6) | 1.000 | 0.600 | 0.600 | 0.150 | 0.150 | 0.989 | 0.989 | 1.000 | 0.364 | 0.148 | 2.452 | 0.215 | 1.452 | 0.489 | 0.250 | 4.000 |
| MULTI-FAN (0.6) | 1.000 | 0.600 | 0.600 | 0.200 | 0.200 | 0.980 | 0.980 | 1.000 | 0.391 | 0.196 | 1.998 | 0.196 | 0.998 | 0.480 | 0.333 | 3.000 |
| MULTI-FAN (0.6) | 1.000 | 0.600 | 0.600 | 0.300 | 0.300 | 0.954 | 0.954 | 1.000 | 0.450 | 0.286 | 1.573 | 0.164 | 0.573 | 0.454 | 0.500 | 2.000 |
| MULTI-FAN (0.6) | 1.000 | 0.600 | 0.600 | 0.400 | 0.400 | 0.917 | 0.917 | 1.000 | 0.516 | 0.367 | 1.408 | 0.150 | 0.408 | 0.417 | 0.667 | 1.500 |
| MULTI-FAN (0.6) | 1.000 | 0.600 | 0.600 | 0.500 | 0.500 | 0.866 | 0.866 | 1.000 | 0.598 | 0.433 | 1.381 | 0.165 | 0.381 | 0.366 | 0.833 | 1.200 |
| MULTI-FAN (0.4) | 1.000 | 0.400 | 0.400 | 0.100 | 0.100 | 0.995 | 0.995 | 1.000 | 0.232 | 0.099 | 2.330 | 0.132 | 1.330 | 0.495 | 0.250 | 4.000 |
| MULTI-FAN (0.4) | 1.000 | 0.400 | 0.400 | 0.150 | 0.150 | 0.989 | 0.989 | 1.000 | 0.287 | 0.148 | 1.936 | 0.139 | 0.936 | 0.489 | 0.375 | 2.667 |
| MULTI-FAN (0.4) | 1.000 | 0.400 | 0.400 | 0.200 | 0.200 | 0.980 | 0.980 | 1.000 | 0.346 | 0.196 | 1.764 | 0.150 | 0.764 | 0.480 | 0.500 | 2.000 |
| MULTI-FAN (0.4) | 1.000 | 0.400 | 0.400 | 0.300 | 0.300 | 0.954 | 0.954 | 1.000 | 0.482 | 0.286 | 1.684 | 0.196 | 0.684 | 0.454 | 0.750 | 1.333 |
| MULTI-FAN (0.3) | 1.000 | 0.300 | 0.300 | 0.100 | 0.100 | 0.995 | 0.995 | 1.000 | 0.225 | 0.099 | 2.264 | 0.126 | 1.264 | 0.495 | 0.333 | 3.000 |
| MULTI-FAN (0.3) | 1.000 | 0.300 | 0.300 | 0.150 | 0.150 | 0.989 | 0.989 | 1.000 | 0.309 | 0.148 | 2.083 | 0.161 | 1.083 | 0.489 | 0.500 | 2.000 |
| MULTI-FAN (0.3) | 1.000 | 0.300 | 0.300 | 0.200 | 0.200 | 0.980 | 0.980 | 1.000 | 0.403 | 0.196 | 2.055 | 0.207 | 1.055 | 0.480 | 0.667 | 1.500 |
| MULTI-FAN (0.2) | 1.000 | 0.200 | 0.200 | 0.100 | 0.100 | 0.995 | 0.995 | 1.000 | 0.283 | 0.099 | 2.842 | 0.183 | 1.842 | 0.495 | 0.500 | 2.000 |
| MULTI-FAN (0.2) | 1.000 | 0.200 | 0.150 | 0.150 | 0.150 | 0.989 | 0.989 | 1.006 | 0.438 | 0.148 | 2.957 | 0.290 | 1.957 | 0.489 | 0.750 | 1.333 |

[FIG. 13B]

EXAMPLE / MULTI-FAN SHAPE IMPROVEMENT BODY

**RATE OF REDUNDANT RATIO:
Redundant ratio of a multi-fan shaped improvement body with respect to redundant ratio of a round shaped improvement body.
*C.I.C.: COLUMN-IN-COLUMN
The c.i.c. risk becomes higher as value becomes closer to 0, and the c.i.c. occurs with negative value.

| SECTIONAL SHAPE | LARGE DIAMETER D1 | SMALL DIAMETER COEFFICIENT b | SMALL DIAMETER D2=b·D1 | WALL THICKNESS COEFFICIENT a | WALL THICKNESS t=a·D1 | PITCH L | PITCH RATIO L/D1 | NUMBER RATIO OF IMPROVEMENT BODIES | SECTIONAL AREA OF IMPROVEMENT BODY Ajg | EFFECTIVE SECTIONAL AREA OF BODY Aw | RATIO OF EFFECTIVE SECTIONAL AREA Ajg/Aw | REDUNDANT AMOUNT Ajg−Aw | REDUNDANT RATIO (Ajg−Aw)/Aw | C.I.C.* D1/2−L | RATE OF REDUNDANT RATIO ** | a/b | b/a | b^2 |
|---|---|---|---|---|---|---|---|---|---|---|---|---|---|---|---|---|---|---|
| MULTI-FAN(a=0.1) | 1.000 | 0.100 | 0.100 | 0.100 | 0.100 | 0.995 | 0.995 | 1.000 | 0.785 | 0.099 | 7.894 | 0.686 | 6.894 | 1.000 | 0.495 | 1.000 | 1.000 | 0.010 |
| MULTI-FAN(a=0.1) | 1.000 | 0.200 | 0.200 | 0.100 | 0.100 | 0.995 | 0.995 | 1.000 | 0.283 | 0.099 | 2.842 | 0.183 | 1.842 | 0.267 | 0.495 | 0.500 | 2.000 | 0.040 |
| MULTI-FAN(a=0.1) | 1.000 | 0.300 | 0.300 | 0.100 | 0.100 | 0.995 | 0.995 | 1.000 | 0.225 | 0.099 | 2.264 | 0.126 | 1.264 | 0.183 | 0.495 | 0.333 | 3.000 | 0.090 |
| MULTI-FAN(a=0.1) | 1.000 | 0.400 | 0.400 | 0.100 | 0.100 | 0.995 | 0.995 | 1.000 | 0.232 | 0.099 | 2.330 | 0.132 | 1.330 | 0.193 | 0.495 | 0.250 | 4.000 | 0.160 |
| MULTI-FAN(a=0.1) | 1.000 | 0.500 | 0.500 | 0.100 | 0.100 | 0.995 | 0.995 | 1.000 | 0.272 | 0.099 | 2.732 | 0.172 | 1.732 | 0.251 | 0.495 | 0.200 | 5.000 | 0.250 |
| MULTI-FAN(a=0.1) | 1.000 | 0.600 | 0.600 | 0.100 | 0.100 | 0.995 | 0.995 | 1.000 | 0.336 | 0.099 | 3.380 | 0.237 | 2.380 | 0.345 | 0.495 | 0.167 | 6.000 | 0.360 |
| MULTI-FAN(a=0.1) | 1.000 | 0.700 | 0.700 | 0.100 | 0.100 | 0.995 | 0.995 | 1.000 | 0.421 | 0.099 | 4.235 | 0.322 | 3.235 | 0.469 | 0.495 | 0.143 | 7.000 | 0.490 |
| MULTI-FAN(a=0.1) | 1.000 | 0.800 | 0.800 | 0.100 | 0.100 | 0.995 | 0.995 | 1.000 | 0.525 | 0.099 | 5.279 | 0.426 | 4.279 | 0.621 | 0.495 | 0.125 | 8.000 | 0.640 |
| MULTI-FAN(a=0.1) | 1.000 | 0.900 | 0.900 | 0.100 | 0.100 | 0.995 | 0.995 | 1.000 | 0.647 | 0.099 | 6.500 | 0.547 | 5.500 | 0.798 | 0.495 | 0.111 | 9.000 | 0.810 |
| MULTI-FAN(a=0.2) | 1.000 | 0.200 | 0.200 | 0.200 | 0.200 | 0.980 | 0.980 | 1.000 | 0.785 | 0.196 | 4.008 | 0.589 | 3.008 | 1.000 | 0.480 | 1.000 | 1.000 | 0.040 |
| MULTI-FAN(a=0.2) | 1.000 | 0.300 | 0.300 | 0.200 | 0.200 | 0.980 | 0.980 | 1.000 | 0.403 | 0.196 | 2.055 | 0.207 | 1.055 | 0.351 | 0.480 | 0.667 | 1.500 | 0.090 |
| MULTI-FAN(a=0.2) | 1.000 | 0.400 | 0.400 | 0.200 | 0.200 | 0.980 | 0.980 | 1.000 | 0.346 | 0.196 | 1.764 | 0.150 | 0.764 | 0.254 | 0.480 | 0.500 | 2.000 | 0.160 |
| MULTI-FAN(a=0.2) | 1.000 | 0.500 | 0.500 | 0.200 | 0.200 | 0.980 | 0.980 | 1.000 | 0.351 | 0.196 | 1.789 | 0.155 | 0.789 | 0.262 | 0.480 | 0.400 | 2.500 | 0.250 |
| MULTI-FAN(a=0.2) | 1.000 | 0.600 | 0.600 | 0.200 | 0.200 | 0.980 | 0.980 | 1.000 | 0.391 | 0.196 | 1.998 | 0.196 | 0.998 | 0.332 | 0.480 | 0.333 | 3.000 | 0.360 |
| MULTI-FAN(a=0.2) | 1.000 | 0.700 | 0.700 | 0.200 | 0.200 | 0.980 | 0.980 | 1.000 | 0.459 | 0.196 | 2.341 | 0.263 | 1.341 | 0.446 | 0.480 | 0.286 | 3.500 | 0.490 |
| MULTI-FAN(a=0.2) | 1.000 | 0.800 | 0.800 | 0.200 | 0.200 | 0.980 | 0.980 | 1.000 | 0.548 | 0.196 | 2.797 | 0.352 | 1.797 | 0.597 | 0.480 | 0.250 | 4.000 | 0.640 |
| MULTI-FAN(a=0.2) | 1.000 | 0.900 | 0.900 | 0.200 | 0.200 | 0.980 | 0.980 | 1.000 | 0.657 | 0.196 | 3.355 | 0.462 | 2.355 | 0.783 | 0.480 | 0.222 | 4.500 | 0.810 |
| MULTI-FAN(a=0.3) | 1.000 | 0.300 | 0.300 | 0.300 | 0.300 | 0.954 | 0.954 | 1.000 | 0.785 | 0.286 | 2.744 | 0.499 | 1.744 | 1.000 | 0.454 | 1.000 | 1.000 | 0.090 |
| MULTI-FAN(a=0.3) | 1.000 | 0.400 | 0.400 | 0.300 | 0.300 | 0.954 | 0.954 | 1.000 | 0.482 | 0.286 | 1.684 | 0.196 | 0.684 | 0.392 | 0.454 | 0.750 | 1.333 | 0.160 |
| MULTI-FAN(a=0.3) | 1.000 | 0.500 | 0.500 | 0.300 | 0.300 | 0.954 | 0.954 | 1.000 | 0.438 | 0.286 | 1.529 | 0.151 | 0.529 | 0.303 | 0.454 | 0.600 | 1.667 | 0.250 |
| MULTI-FAN(a=0.3) | 1.000 | 0.600 | 0.600 | 0.300 | 0.300 | 0.954 | 0.954 | 1.000 | 0.450 | 0.286 | 1.573 | 0.164 | 0.573 | 0.329 | 0.454 | 0.500 | 2.000 | 0.360 |
| MULTI-FAN(a=0.3) | 1.000 | 0.700 | 0.700 | 0.300 | 0.300 | 0.954 | 0.954 | 1.000 | 0.498 | 0.286 | 1.739 | 0.212 | 0.739 | 0.424 | 0.454 | 0.429 | 2.333 | 0.490 |
| MULTI-FAN(a=0.3) | 1.000 | 0.800 | 0.800 | 0.300 | 0.300 | 0.954 | 0.954 | 1.000 | 0.572 | 0.286 | 1.998 | 0.286 | 0.998 | 0.572 | 0.454 | 0.375 | 2.667 | 0.640 |
| MULTI-FAN(a=0.3) | 1.000 | 0.900 | 0.900 | 0.300 | 0.300 | 0.954 | 0.954 | 1.000 | 0.668 | 0.286 | 2.336 | 0.382 | 1.336 | 0.766 | 0.454 | 0.333 | 3.000 | 0.810 |

[FIG. 13C]

EXAMPLE / MULTI-FAN SHAPE IMPROVEMENT BODY

**RATE OF REDUNDANT RATIO:
Redundant ratio of a multi-fan shaped improvement body with respect to redundant ratio of a round shaped improvement body.
*C.I.C.: COLUMN-IN-COLUMN
The c.i.c. risk becomes higher as value becomes closer to 0, and the c.i.c. occurs with negative value.

| SECTIONAL SHAPE | LARGE DIAMETER D1 | SMALL DIAMETER COEFFICIENT b | SMALL DIAMETER D2=b•D1 | WALL THICKNESS COEFFICIENT a | WALL THICKNESS t=a•D1 | PITCH L | PITCH RATIO L/D1 | NUMBER RATIO OF IMPROVEMENT BODIES | SECTIONAL AREA OF IMPROVEMENT BODY Ajg | EFFECTIVE SECTIONAL AREA OF BODY Aw | RATIO OF EFFECTIVE SECTIONAL AREA Ajg/Aw | REDUNDANT AMOUNT Ajg−Aw | REDUNDANT RATIO (Ajg−Aw)/Aw | C.I.C.* D1/2−L | RATE OF REDUNDANT RATIO ** | a/b | b/a | b^2 |
|---|---|---|---|---|---|---|---|---|---|---|---|---|---|---|---|---|---|---|
| MULTI-FAN (a=0.4) | 1.000 | 0.400 | 0.400 | 0.400 | 0.400 | 0.917 | 0.917 | 1.000 | 0.785 | 0.367 | 2.142 | 0.419 | 1.142 | 1.000 | 0.417 | 1.000 | 1.000 | 0.160 |
| MULTI-FAN (a=0.4) | 1.000 | 0.500 | 0.500 | 0.400 | 0.400 | 0.917 | 0.917 | 1.000 | 0.544 | 0.367 | 1.484 | 0.177 | 0.484 | 0.424 | 0.417 | 0.800 | 1.250 | 0.250 |
| MULTI-FAN (a=0.4) | 1.000 | 0.600 | 0.600 | 0.400 | 0.400 | 0.917 | 0.917 | 1.000 | 0.516 | 0.367 | 1.408 | 0.150 | 0.408 | 0.357 | 0.417 | 0.667 | 1.500 | 0.360 |
| MULTI-FAN (a=0.4) | 1.000 | 0.700 | 0.700 | 0.400 | 0.400 | 0.917 | 0.917 | 1.000 | 0.540 | 0.367 | 1.473 | 0.173 | 0.473 | 0.414 | 0.417 | 0.571 | 1.750 | 0.490 |
| MULTI-FAN (a=0.4) | 1.000 | 0.800 | 0.800 | 0.400 | 0.400 | 0.917 | 0.917 | 1.000 | 0.597 | 0.367 | 1.628 | 0.230 | 0.628 | 0.550 | 0.417 | 0.500 | 2.000 | 0.640 |
| MULTI-FAN (a=0.4) | 1.000 | 0.900 | 0.900 | 0.400 | 0.400 | 0.917 | 0.917 | 1.000 | 0.680 | 0.367 | 1.855 | 0.313 | 0.855 | 0.748 | 0.417 | 0.444 | 2.250 | 0.810 |
| MULTI-FAN (a=0.5) | 1.000 | 0.500 | 0.500 | 0.500 | 0.500 | 0.866 | 0.866 | 1.000 | 0.785 | 0.433 | 1.814 | 0.352 | 0.814 | 1.000 | 0.366 | 1.000 | 1.000 | 0.250 |
| MULTI-FAN (a=0.5) | 1.000 | 0.600 | 0.600 | 0.500 | 0.500 | 0.866 | 0.866 | 1.000 | 0.598 | 0.433 | 1.381 | 0.165 | 0.381 | 0.468 | 0.366 | 0.833 | 1.200 | 0.360 |
| MULTI-FAN (a=0.5) | 1.000 | 0.700 | 0.700 | 0.500 | 0.500 | 0.866 | 0.866 | 1.000 | 0.588 | 0.433 | 1.357 | 0.155 | 0.357 | 0.439 | 0.366 | 0.714 | 1.400 | 0.490 |
| MULTI-FAN (a=0.5) | 1.000 | 0.800 | 0.800 | 0.500 | 0.500 | 0.866 | 0.866 | 1.000 | 0.624 | 0.433 | 1.441 | 0.191 | 0.441 | 0.542 | 0.366 | 0.625 | 1.600 | 0.640 |
| MULTI-FAN (a=0.5) | 1.000 | 0.900 | 0.900 | 0.500 | 0.500 | 0.866 | 0.866 | 1.000 | 0.692 | 0.433 | 1.598 | 0.259 | 0.598 | 0.735 | 0.366 | 0.556 | 1.800 | 0.810 |
| MULTI-FAN (a=0.6) | 1.000 | 0.600 | 0.600 | 0.600 | 0.600 | 0.800 | 0.800 | 1.000 | 0.785 | 0.480 | 1.636 | 0.305 | 0.636 | 1.000 | 0.300 | 1.000 | 1.000 | 0.360 |
| MULTI-FAN (a=0.6) | 1.000 | 0.700 | 0.700 | 0.600 | 0.600 | 0.800 | 0.800 | 1.000 | 0.647 | 0.480 | 1.349 | 0.167 | 0.349 | 0.548 | 0.300 | 0.857 | 1.167 | 0.490 |
| MULTI-FAN (a=0.6) | 1.000 | 0.800 | 0.800 | 0.600 | 0.600 | 0.800 | 0.800 | 1.000 | 0.655 | 0.480 | 1.365 | 0.175 | 0.365 | 0.574 | 0.300 | 0.750 | 1.333 | 0.640 |
| MULTI-FAN (a=0.6) | 1.000 | 0.900 | 0.900 | 0.600 | 0.600 | 0.800 | 0.800 | 1.000 | 0.705 | 0.480 | 1.470 | 0.225 | 0.470 | 0.738 | 0.300 | 0.667 | 1.500 | 0.810 |
| MULTI-FAN (a=0.7) | 1.000 | 0.700 | 0.700 | 0.700 | 0.700 | 0.714 | 0.714 | 1.000 | 0.785 | 0.500 | 1.571 | 0.285 | 0.571 | 1.000 | 0.214 | 1.000 | 1.000 | 0.490 |
| MULTI-FAN (a=0.7) | 1.000 | 0.800 | 0.800 | 0.700 | 0.700 | 0.714 | 0.714 | 1.000 | 0.694 | 0.500 | 1.389 | 0.195 | 0.389 | 0.681 | 0.214 | 0.875 | 1.143 | 0.640 |
| MULTI-FAN (a=0.7) | 1.000 | 0.900 | 0.900 | 0.700 | 0.700 | 0.714 | 0.714 | 1.000 | 0.721 | 0.500 | 1.442 | 0.221 | 0.442 | 0.774 | 0.214 | 0.778 | 1.286 | 0.810 |
| MULTI-FAN (a=0.8) | 1.000 | 0.800 | 0.800 | 0.800 | 0.800 | 0.600 | 0.600 | 1.000 | 0.785 | 0.480 | 1.636 | 0.305 | 0.636 | 1.000 | 0.100 | 1.000 | 1.000 | 0.640 |
| MULTI-FAN (a=0.8) | 1.000 | 0.850 | 0.850 | 0.800 | 0.800 | 0.600 | 0.600 | 1.000 | 0.738 | 0.480 | 1.537 | 0.258 | 0.537 | 0.843 | 0.100 | 0.941 | 1.063 | 0.723 |
| MULTI-FAN (a=0.8) | 1.000 | 0.900 | 0.900 | 0.800 | 0.800 | 0.600 | 0.600 | 1.000 | 0.740 | 0.480 | 1.542 | 0.260 | 0.542 | 0.852 | 0.100 | 0.889 | 1.125 | 0.810 |

[FIG. 14A]
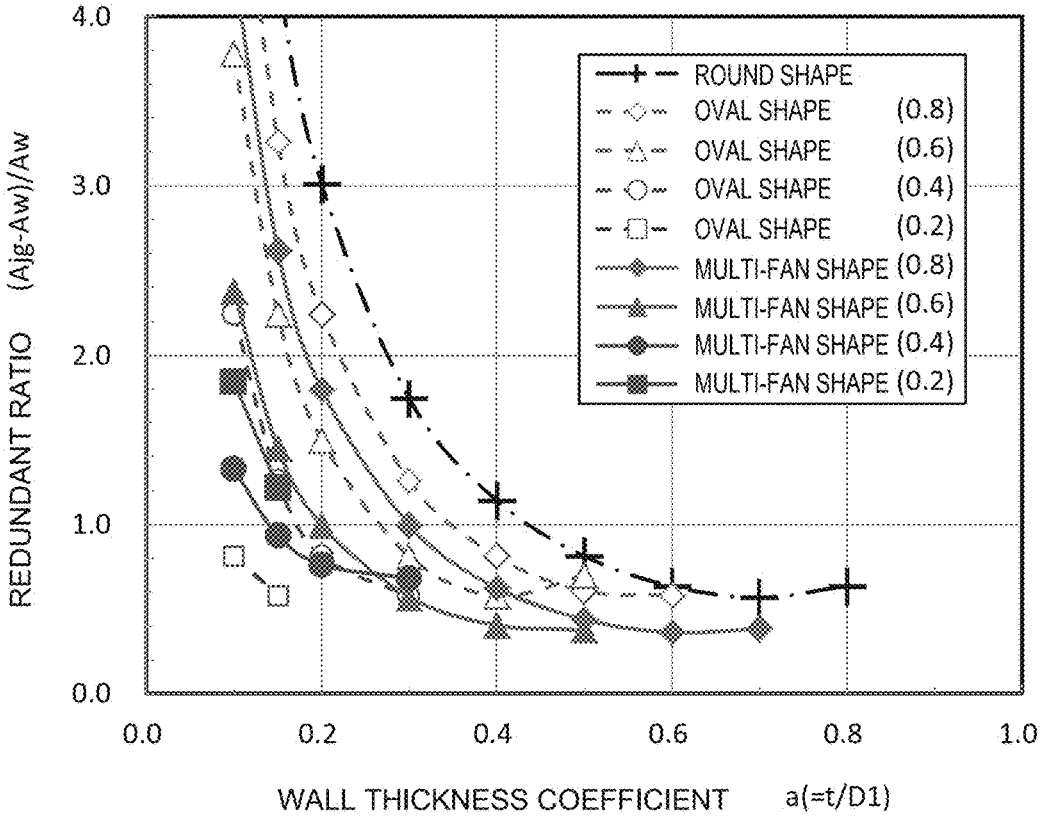

[FIG. 14B]
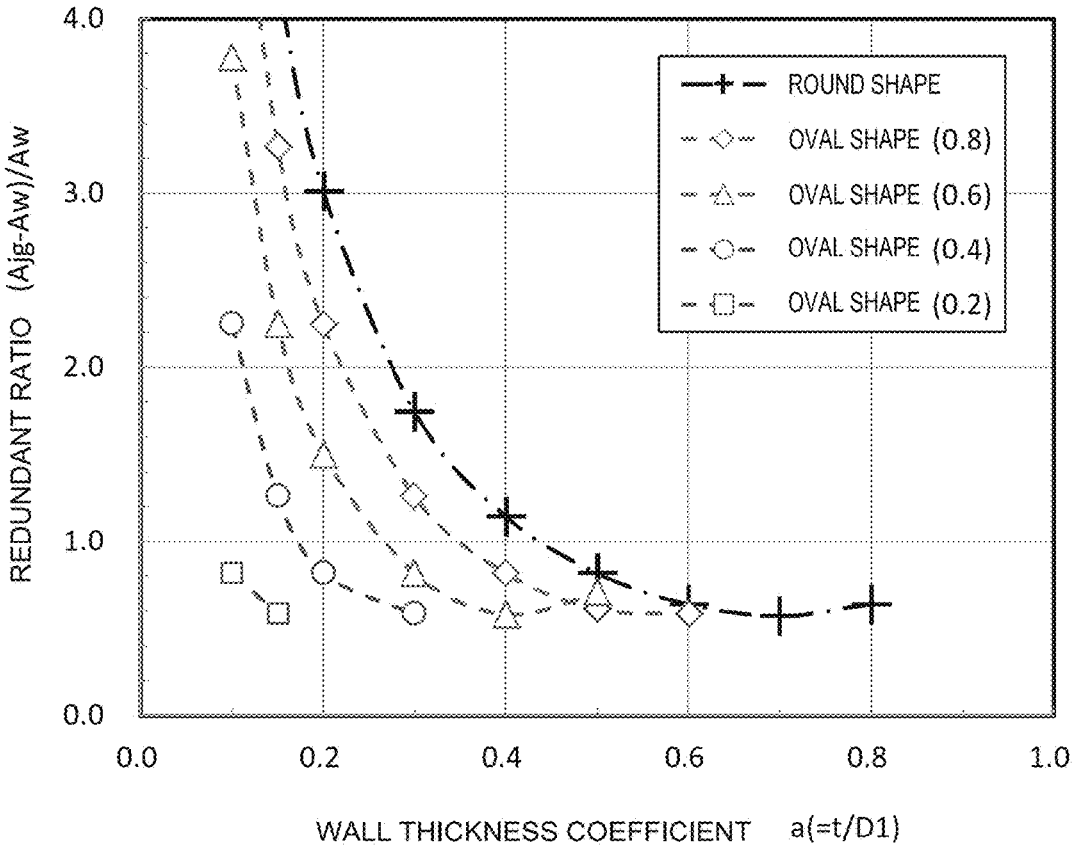

[FIG. 14C]
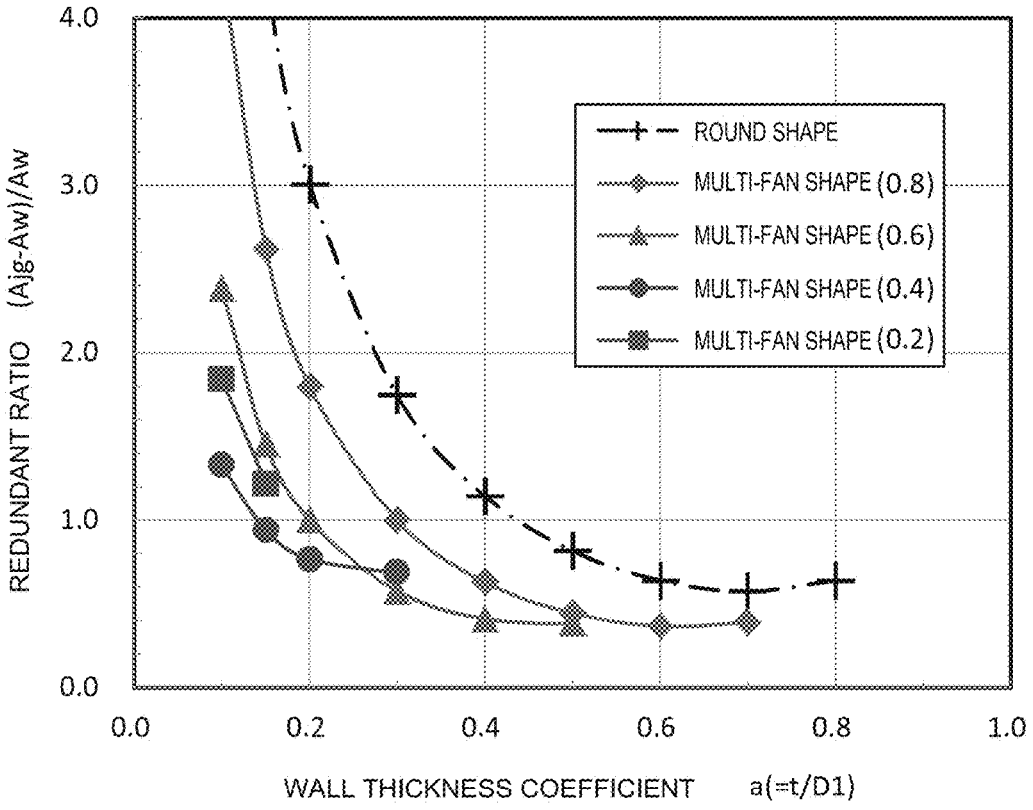

[FIG. 15]
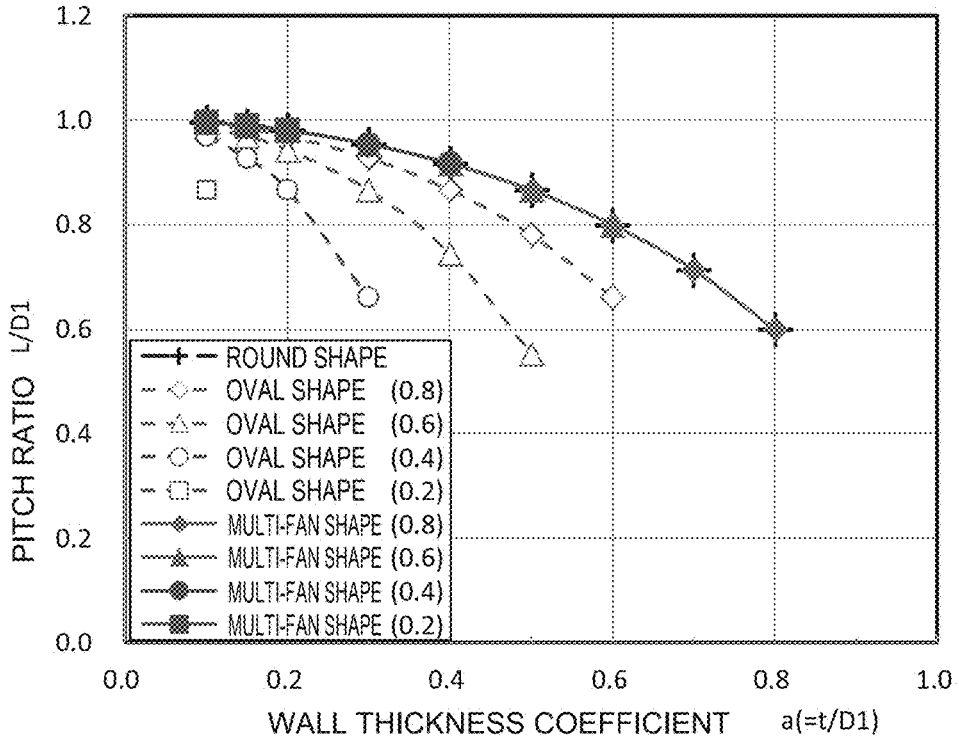
[FIG. 16]
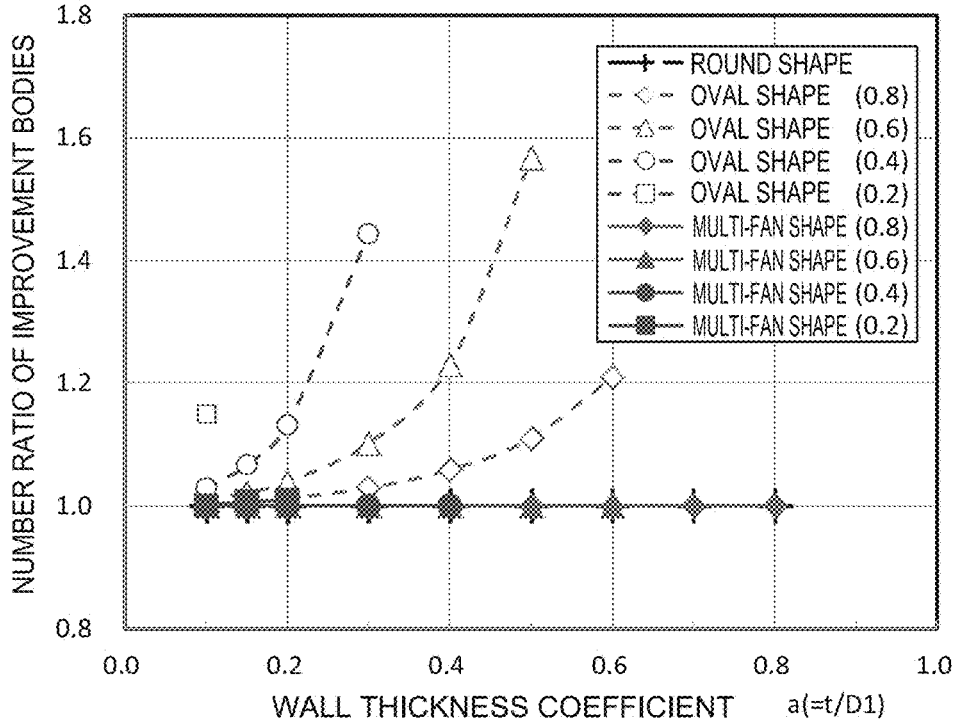

[FIG. 17]
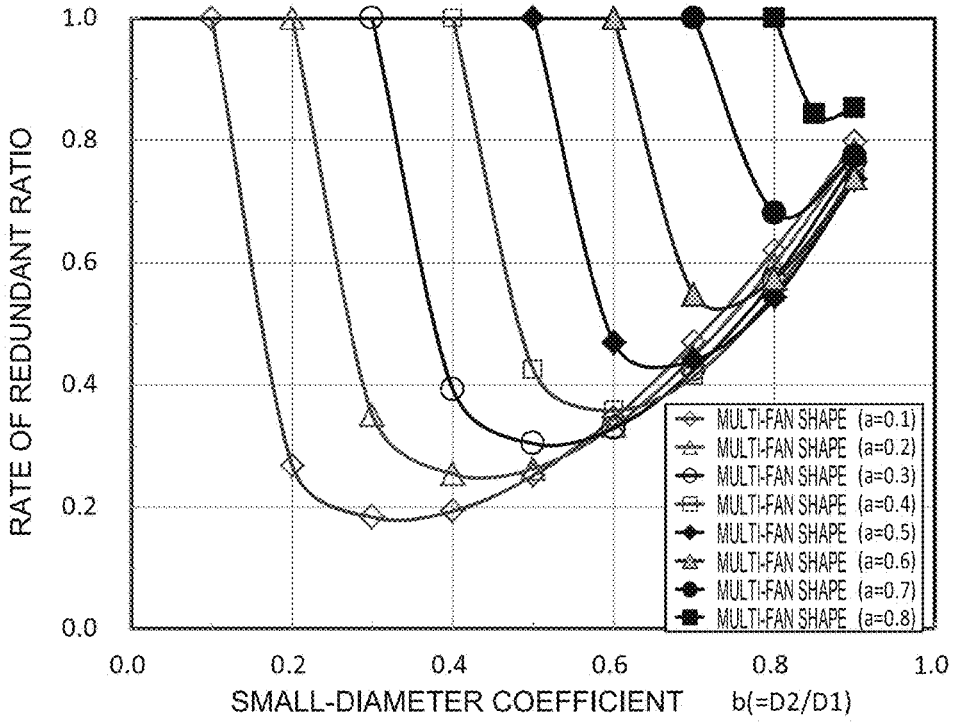
[FIG. 18]
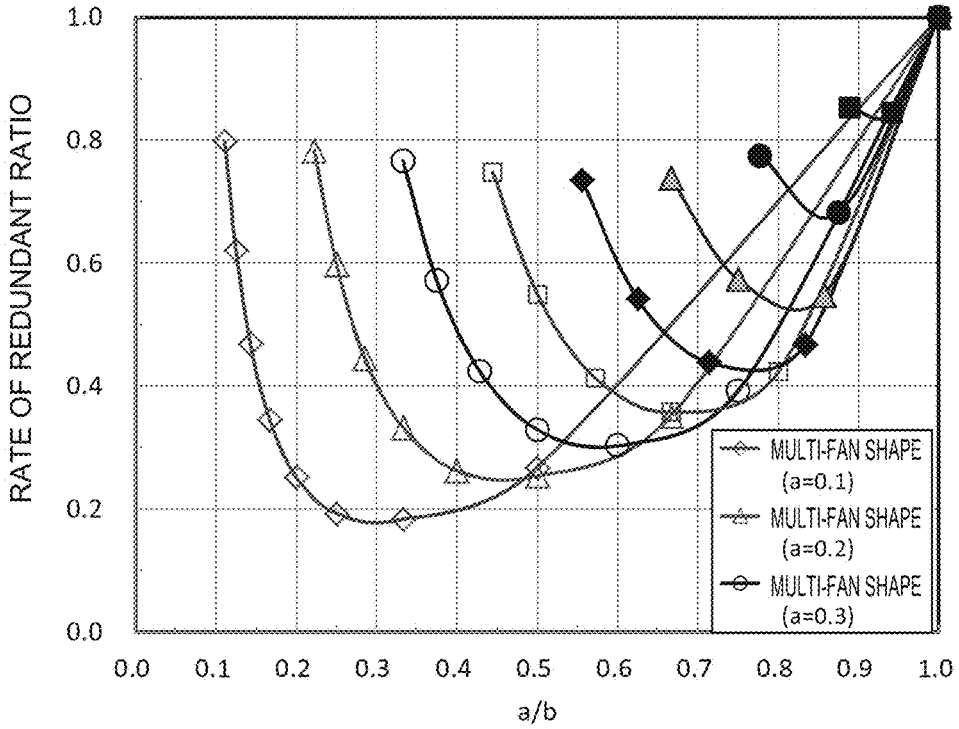

[FIG. 19]
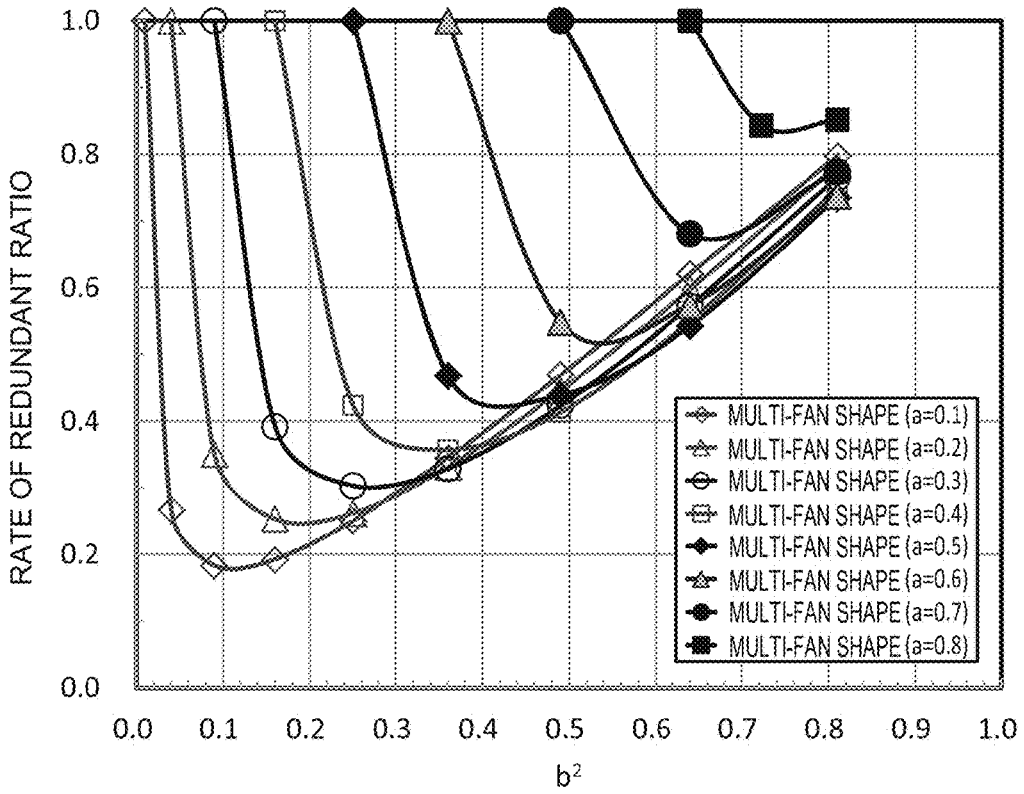

[FIG. 20]
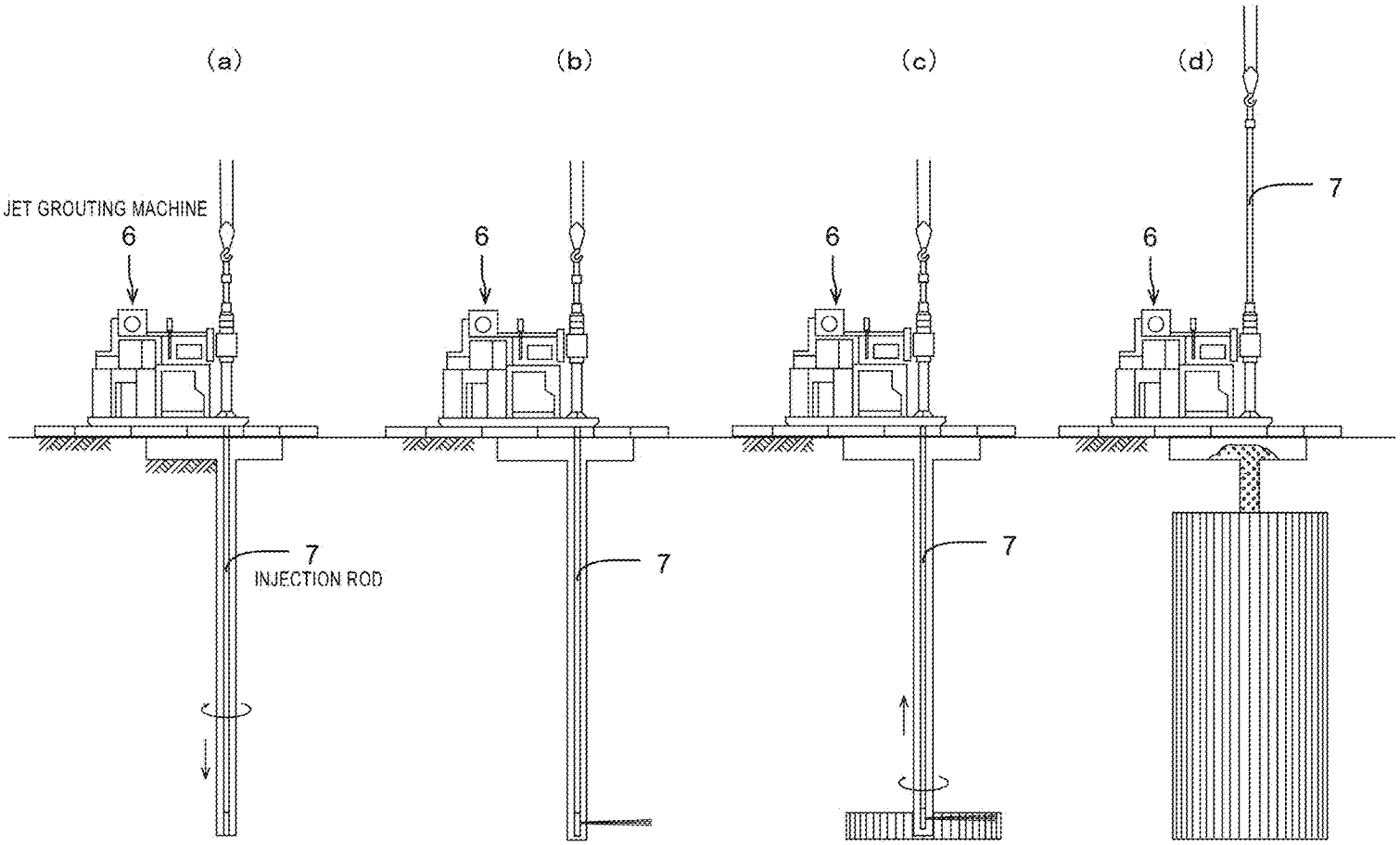

[FIG. 21]
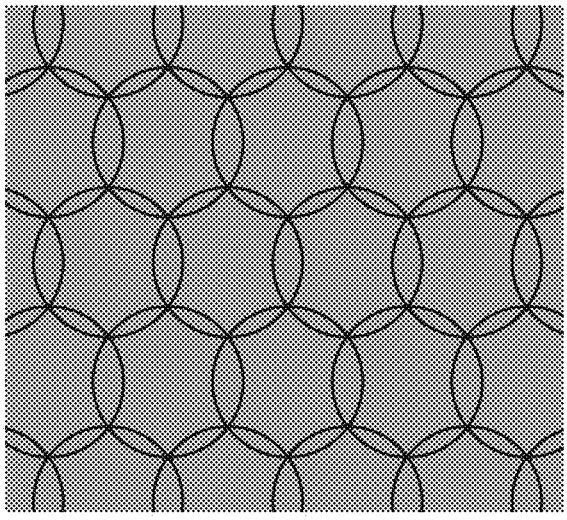
(a) OVERLAPPING ARRANGEMENT OF IMPROVEMENT BODIES
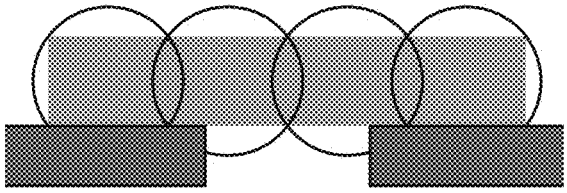
(b) WALL FORM
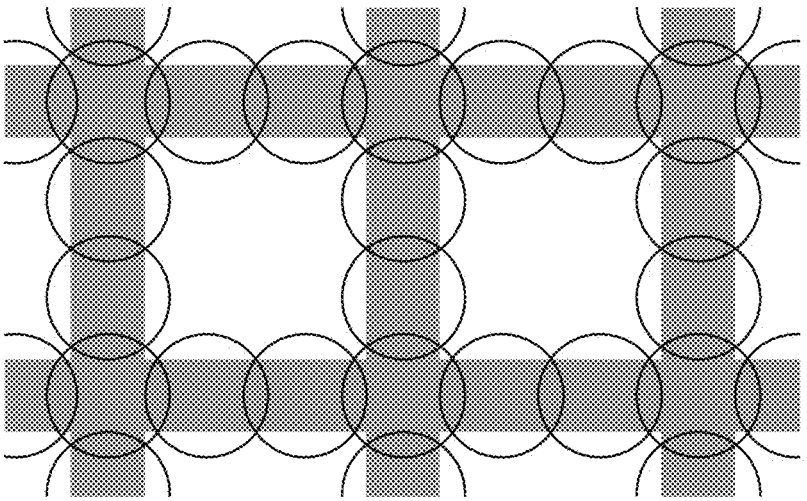
(c) LATTICE FORM

[FIG. 22]
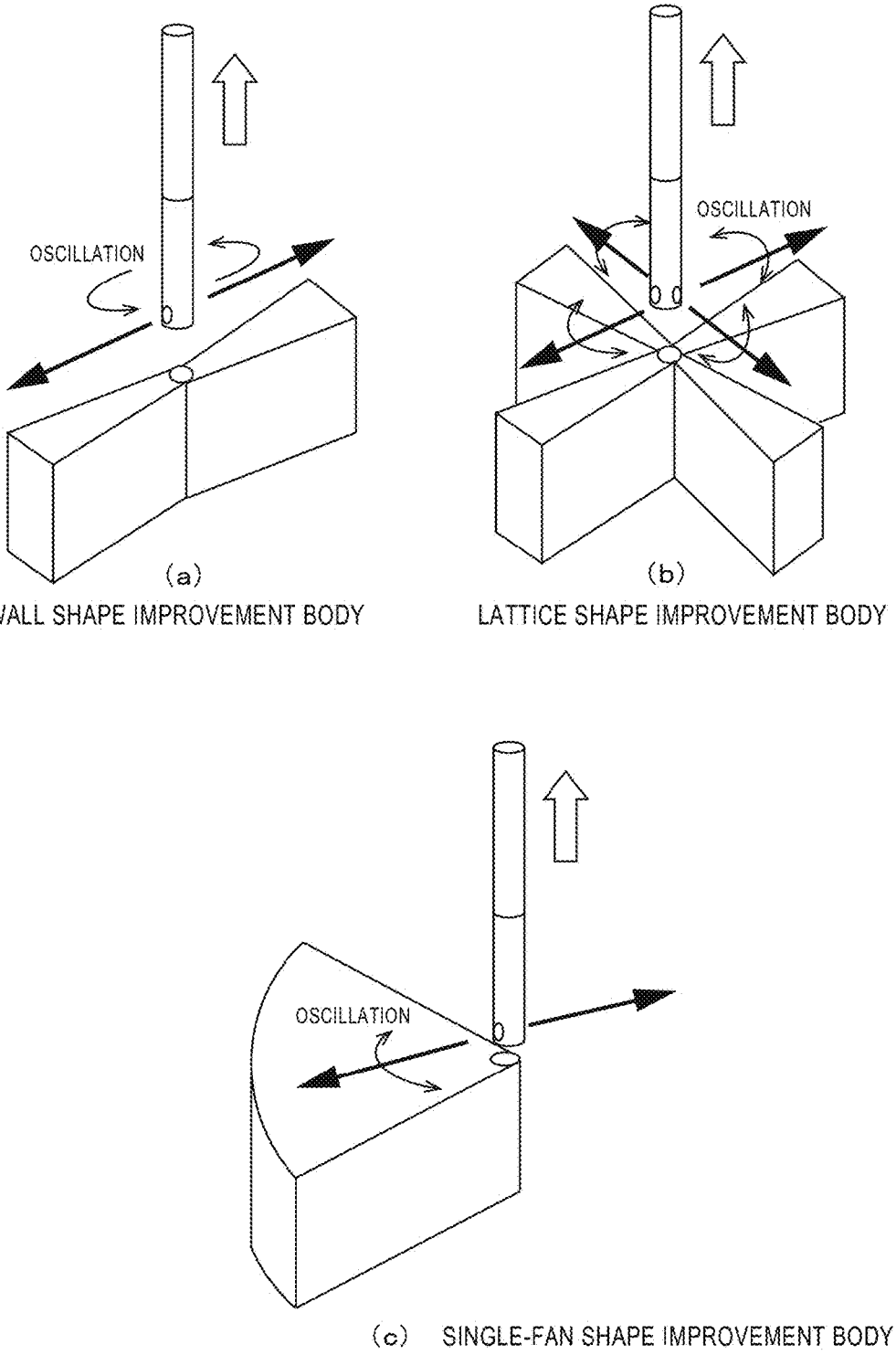

[FIG. 23]
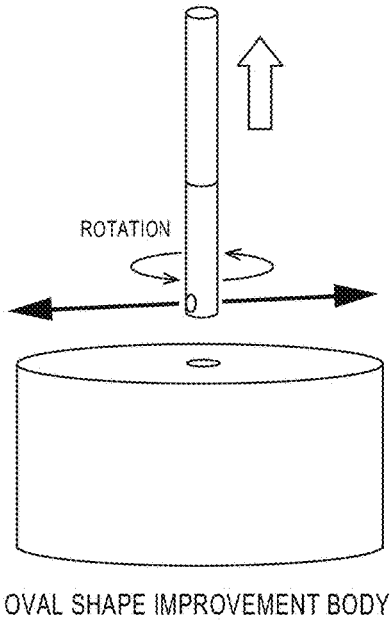
[FIG. 24]
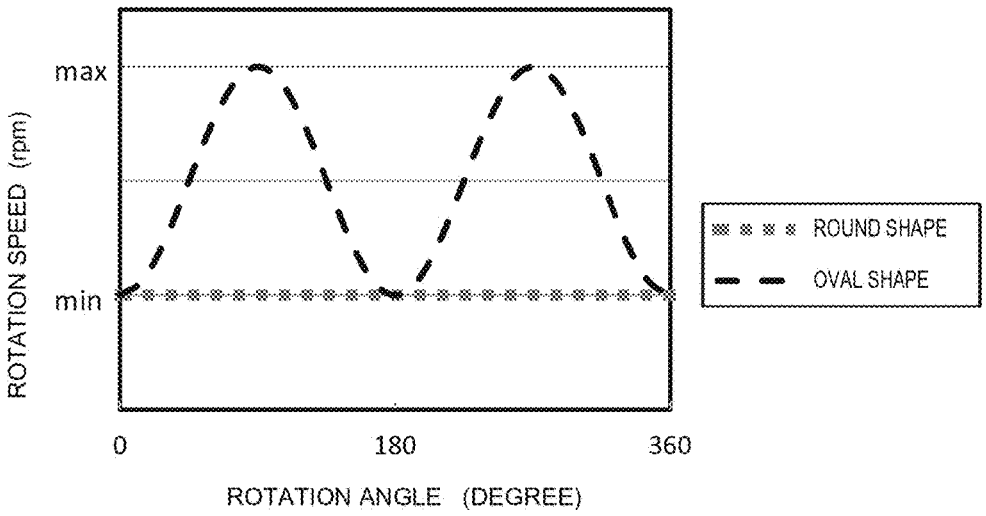

[FIG. 25]
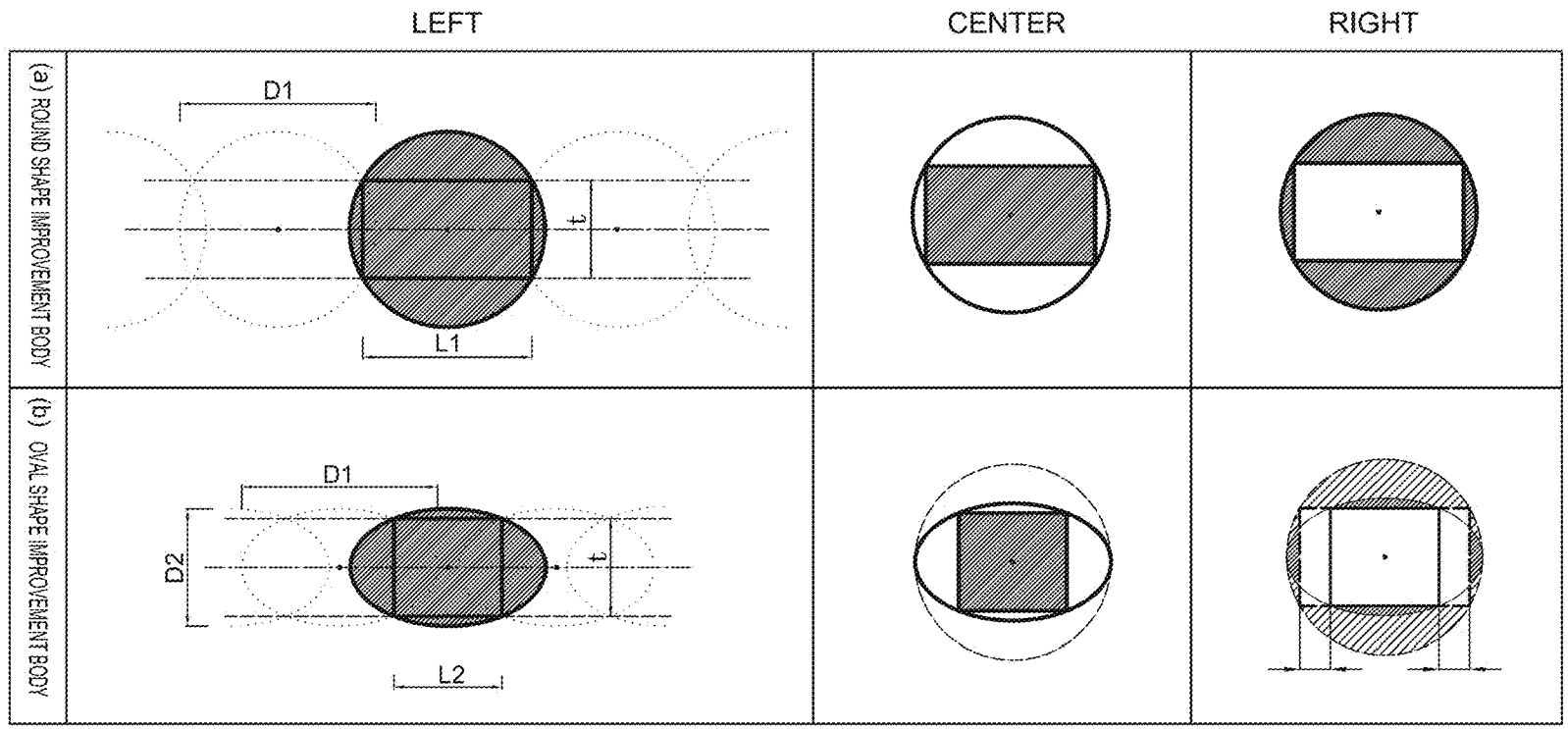

JET GROUTING METHOD, GROUND IMPROVEMENT BODY, AND GROUND IMPROVEMENT STRUCTURE

TECHNICAL FIELD

The present invention relates to a method of constructing a ground improvement body through use of a jet grouting method in which an improving material is injected at high pressure to mix it with in-situ soil, and a method of constructing a ground improvement structure formed of a plurality of ground improvement bodies. Further, the present invention relates to the ground improvement body and the ground improvement structure. In this application, a ground improvement body is referred to as "improvement body". Further, a ground improvement structure is referred to as "improvement structure".

BACKGROUND ART

Jet grouting is generally known as a method for ground improvement, anduses an injection rod (drill rod) having an injection nozzle arranged at a bottom end of the injection rod. In the jet grouting, a pressurized air and an improving material (self-hardening material) are injected from the injection nozzle of the injection rod in a horizontal direction. The improving material injected from the nozzle breaks up in-situ soil so that the injected material is mixed with the broken soil. Typically, the injection rod advanced to a design depth in the ground is rotated and is raised in a stepwise manner by several centimeters (specifically, the injection rod is pulled up stepwisely at certain time intervals), thereby constructing an improvement body having an approximately columnar shape (cylindrical shape) with a large diameter. An overview of steps of the jet grouting method is illustrated in FIG. 20.

<Step a>

As illustrated in FIG. 20(*a*), a jet grouting machine 6 is installed at a position where the improvement body (column) is to be constructed. An injection rod 7 (drill rod) is assembled to the jet grouting machine 6 while being suspended by a crane. Then, the injection rod 7 is advanced to a predetermined depth in the ground to be treated, while discharging drilling water from a bottom end of the injection rod 7 and being rotated by the jet grouting machine 6.

<Step b>

After the injection rod 7 is advanced to the predetermined depth in the ground, a rotation speed (rpm) and raising speed (s/m) of the injection rod are set appropriately. Then, injection of the improving material (grout) is started. The improving material is injected at high pressure from the injection nozzle arranged at the bottom end of the injection rod 7. In-situ soil is broken up and loosened with high kinetic energy of a jet flow of the improving material.

<Step c>

Through rotation of the injection rod 7 at the set rotation speed, the in-situ soil is broken up and loosened by the jet flow of the improving material injected at high pressure, and the improving material is forcibly mixed with the broken in-situ soil. In this way, the improvement body is partially formed at the first stage. Then, the jet grouting machine 6 is actuated so that the injection rod 7 is lifted up in a stepwise manner to a second stage, a third stage, and so on. For example, a step length (length per step) is set to 25 mm. The number of steps per meter is set to forty. As described above, the improving material is injected from the injection nozzle of the injection rod at high pressure while the injection rod is rotated at the set speed in each stage. The injection rod is lifted up in the stepwise manner in accordance with the set raising speed, thereby being capable of constructing the improvement body having a substantially columnar shape.

<Step d>

After the improvement body with a predetermined dimension is constructed in the ground to be treated, the injection rod 7 is withdrawn above the ground. Then, the inside of the injection rod 7 is washed with water.

CITATION LIST

Patent Literature

[PTL 1] JP 02-27015 A

SUMMARY OF INVENTION

Technical Problem

In the jet grouting method, a slurry-like improving material (grout) is injected from the injection nozzle of the rotating rod. Thus, the jet grouting method is typically for use in construction of an improvement body having a round sectional shape. When the ground improvement has to be carried out at 100% as in a case of full improvement (for example, in a case of batholith improvement), a plurality of ground improvements with round sectional shapes are constructed in an overlapping arrangement (FIG. 21(*a*)).

However, when a wall-form arrangement (FIG. 21(*b*)) for protection of a soil retainer absent part or a lattice-form arrangement (FIG. 21(*c*)) for countermeasures to liquefaction has to be achieved, the round sectional shape as described above causes formation of a large unnecessary portion exceeding an effective wall thickness (wall thickness required in design).

In particular, as a diameter of an underground pipe is increased, a necessary diameter of the improvement body increases with respect to the effective wall thickness. As a result, area of the unnecessary portion is increased. When the unnecessary portion increases, material cost and sludge removal cost increase, which may cause a worse impact on the environment.

Further, along with the above-mentioned increases, a required construction time also increases.

Further, in the case of the protection of the soil retainer absent part, drilling is carried out so as to leave a wall-form part. At that time, the increase in unnecessary portion of each improvement body may cause not only degradation in drilling efficiency but also the necessity of high industrial waste disposal cost, which may result in increase in the construction cost and increase in the environmental load.

In order to solve the above-mentioned problems, consideration has been made on construction of a wall shape improvement body, a lattice shape improvement body, or a single-fan shape improvement body as illustrated in FIG. 22. The wall shape, lattice shape, and single-fan shape improvement bodies are constructed through injecting of the slurry-like improving material while oscillating the injection rod as illustrated in FIG. 22.

However, in the case of constructing the wall shape, lattice shape, or single-fan shape improvement body as illustrated in FIG. 22, there arises a problem in that a necessary wall thickness (effective wall thickness) cannot be secured in a central portion (axis) of the improvement body.

In view of this, consideration has been made on construction of an oval shape improvement body as illustrated in FIG. 23. The oval shape improvement body can ensure the necessary wall thickness (effective wall thickness) in the center portion (axis) thereof, while it reduces an area (volume) of the redundant portion. The oval shape improvement body is constructed by "continuously changing" the rotation speed of the rod injecting the improving material, as shown in FIG. 24.

When constructing the oval shape improvement body, a maximum diameter thereof is determined depending on ability of a jet grouting. In this case, a construction pitch (spacing) between improvement bodies to be constructed has to be narrowed (pitch L2<L1 in FIG. 25) in order to secure the necessary wall thickness. Specifically, as illustrated in FIG. 25, when the improvement body, which has been constructed to have the round shape in the prior art, is now formed into the oval shape, the construction pitch (i.e., spacing of improvement bodies) that can secure a wall thickness t is L1 in the case of the round shape improvement body, whereas the construction pitch is L2 (L2<L1) in the case of the oval shape improvement body.

When the construction pitch (i.e., spacing of improvement bodies) is narrowed as described above, the number of improvement bodies to be constructed is increased. Specifically, when the improvement body is formed into the oval sectional shape, the area of the unnecessary portion (volume of a redundant portion exceeding the effective wall thickness t) is reduced. However, the construction pitch is narrowed, and hence the number of improvement bodies to be constructed is increased. Therefore, total construction cost is not necessarily reduced, and is even increased in some cases.

Further, when an oblateness of the oval shape is increased, an overlapping width between adjacent improvement bodies has to be increased. In this case, because the jet flow of the improving material reaches a center (position of jetting) of the adjacent improvement body, a risk of causing a so-called column-in-column state is increased. In the column-in-column state, the in-situ soil cannot be broken up even with injecting of the improving material. As a result, there is a possibility of causing construction failures such as disabled construction of an adjacent improvement body and reduction in diameter of an improvement body.

Further, as shown in FIG. 24, in order to "continuously change" the rotation speed of the injection rod for construction of the oval shape improvement body, an apparatus configured to control a jet grouting machine is required. Many of general jet grouting machines are hydraulically controlled. Therefore, in order to continuously change the rotation speed of the injection rod, the amount of oil to be used for the hydraulic control of the rotation has to be continuously increased or reduced, which may result in an apparatus having a complicated configuration (i.e., apparatus configured to open/close a valve in a non-step manner). In the hydraulic control, the amount of oil as well as viscosity thereof changes depending on oil temperature. Therefore, there are needed an instrument or a controller configured to give feedbacks on the amount of opening/closing of the valve in accordance with the oil temperature or the viscosity. Thus, there arises a problem in that size and weight of a machine and equipment for the jet grouting are increased, in addition to a problem in that mechanical control is complicated. Further, the problems cause significant degradation in construction efficiency.

In view of the above-mentioned problems of the prior art, an object of the present invention is to provide a jet grouting method, an improvement body, and an improvement structure, which are capable of reducing an unnecessary portion (redundant portion) exceeding an effective wall thickness without narrowing a construction pitch (spacing) between improvement bodies, and capable of allowing easy mechanical control at the time of construction of the improvement body.

Solution to Problem

In order to achieve the above object, the present invention is directed to a jet grouting method for improving a ground to be treated, the method including:

forming an improvement body by injecting an improving material into the ground via an injection rod while rotating the injection rod in the ground, the improvement body having a sectional shape which is a combination of different kinds of fan shapes having different radiuses, the ground improvement body being formed so as to have an effective wall thickness that is required in design thereof, in which the sectional shape of the improvement body is a combination of at least two kinds of fan shapes, one of the two kinds corresponding to a fan shape having a smaller radius, and the other corresponding to a fan shape having a larger radius, and in which the at least two kinds of fan shapes are arranged in order by radius size in a longitudinal direction of the effective wall thickness (i.e., in a direction perpendicular to the thickness direction of the effective wall thickness) while fan shapes having the smallest radius are arranged in the thickness direction of the effective wall thickness.

In the jet grouting method, the improvement body is constructed so as to satisfy the condition that an effective wall thickness is 0.7 times a maximum diameter of the improvement body or smaller.

Further, in the jet grouting method, the improvement body is constructed so as to satisfy the condition that the minimum diameter of the improvement body is 0.2 times to 0.8 times the maximum diameter thereof.

Further, in the jet grouting method, the improvement body is constructed so as to satisfy the condition that a/b is 0.9 or smaller. In this condition, a is a wall thickness coefficient that is obtained by dividing the effective wall thickness by the maximum diameter of the improvement body, and b is a small-diameter coefficient that is obtained by dividing the minimum diameter of the improvement body by the maximum diameter.

Further, in the jet grouting method, it is preferred that, when designing the improvement body to be constructed, a central angle of the fan shape having the smallest radius is determined with respect to (on the basis of) the effective wall thickness. In addition, it is also preferred that central angles of the fan shapes are determined in ascending order by radius size from the fan shape having the smallest radius.

The term "effective wall thickness" represents a dimension on a short side of a maximum rectangular sectional region that can be included in the improvement body. The rectangular sectional region has a maximum size that can be included in the improvement body. The section herein represents a section in a horizontal direction.

Further, in the jet grouting method, it is preferred that, when forming the improvement body, a rotation speed of the injection rod injecting the improving material is changed stepwisely to control a diameter of the improvement body to be constructed.

Further, in the jet grouting method, it is preferred that the sectional shape of the improvement body is a combination of two to five kinds of fan shapes having different radiuses.

Further, in the jet grouting method, it is preferred that the improving material injected via the injection rod in the ground breaks up and loosens in-situ soil, and a state of the in-situ soil is monitored when breaking up and loosening the in-situ soil by injecting the improving material.

Further, in the jet grouting method, a plurality of improvement bodies are formed to construct an improvement structure formed of the plurality of improvement bodies.

Further, in order to achieve the above object, the present invention is also directed to an improvement body which is constructed through use of a jet grouting method. In the jet grouting method, an improving material is injected into the ground via an injection rod while rotating the injection rod in the ground. The improvement body has a sectional shape which is a combination of different kinds of fan shapes having different radiuses.

Still further, in order to achieve the above object, the present invention is also directed to an improvement structure including a plurality of improvement bodies. Each of the improvement bodies is constructed through use of a jet grouting method, and is constructed so as to satisfy an effective wall thickness that is required in design thereof. In the jet grouting method, an improving material is injected into the ground via an injection rod while rotating the injection rod in the ground. Each of the improvement bodies has a sectional shape which is a combination of different kinds of fan shapes having different radiuses. Further, the improvement bodies forming the improvement structure are arranged in an overlapping manner.

In each of the improvement bodies forming the improvement structure, the sectional shape of the improvement body is a combination of at least two kinds of fan shapes, in which one of the two kinds corresponds to a fan shape having a smaller radius, and the other corresponds to a fan shape having a larger radius. Further, the at least two kinds of fan shapes are arranged in order by radius size in a longitudinal direction of the effective wall thickness (i.e., in a direction perpendicular to the thickness direction of the effective wall thickness) while fan shapes having the smallest radius are arranged in a direction of the effective wall thickness.

In the improvement body, the effective wall thickness is preferably 0.7 times a maximum diameter of the improvement body or smaller.

Further, the minimum diameter of the improvement body is preferably set to be 0.2 times to 0.8 times the maximum diameter thereof.

Still further, a/b is preferably 0.9 or smaller, where a is a wall thickness coefficient that is obtained by dividing the effective wall thickness by the maximum diameter of the improvement body, and where b is a small-diameter coefficient that is obtained by dividing the minimum diameter of the improvement body by the maximum diameter.

The maximum diameter of the improvement body to be constructed by the jet grouting method depends on ability of the jet grouting, such as an injection pressure/amount of the improving material, and a raising/rotation speed of the injection rod. Therefore, by normalizing the minimum diameter and the effective wall thickness by the maximum diameter of the improvement body, various combinations of thicknesses and diameters for an improvement body can be evaluated. Further, a construction pitch (spacing) between improvement bodies depends on the maximum diameter of each improvement body to be constructed and the effective wall thickness thereof. Therefore, by normalizing the pitch by the maximum diameter of each improvement body to be constructed, a risk of causing the column-in-column can also be evaluated.

Advantageous Effects of Invention

According to the jet grouting method of the present invention, an improvement body is formed by injecting an improving material (grout) into a ground via an injection rod while rotating the injection rod in the ground. The improvement body is formed so as to have a sectional shape (MultiFan shape) which is a combination of different kinds of fan shapes (sector shapes) having different radiuses.

Through formation of the improvement body having the MultiFan shape, an area of an unnecessary portion (volume of a redundant portion exceeding the effective wall thickness t) is reduced. Specifically, a redundant ratio (i.e., a ratio of area/volume of the unnecessary portion to the effective area/volume of the improvement body) becomes smaller than those in the cases of the round shape and the oval shape. Therefore, the amount of use of the improving material as well as the amount of sludge removal is significantly reduced. That is, the amount of material for the improvement body to be constructed is reduced as compared to the cases of constructing the round shape improvement body and the oval shape improvement body. Thus, as a result, material cost as well as sludge removal cost (i.e., cost for the disposal of industrial waste) is significantly reduced.

Further, the construction pitch (spacing) between the MultiFan shape improvement bodies having the effective wall thickness is equal to that for round shape improvement bodies of the prior art (pitch L3=L1 in FIG. 1). Therefore, the number of improvement bodies to be constructed is also set equal to that of the round shape improvement bodies of the prior art. That is, according to the present invention, the amount of material to be injected is reduced, and drilling cost is not increased. (Note that, in the case of constructing an improvement structure formed of oval shape improvement bodies, the amount of material to be injected is not reduced and drilling cost is increased.) Further, according to the present invention, the risk of causing the column-in-column state is reduced.

As described above, according to the present invention, the area of the unnecessary portion (volume of the redundant portion exceeding the effective wall thickness t) of the improvement body is reduced, while the construction pitch (i.e., spacing between improvement bodies) equal to that in the case of the construction of the round shape improvement body is kept. Therefore, the present invention has both an advantage obtained in the case of constructing the round shape improvement body (which is constructed with a wide pitch) and an advantage obtained in the case of constructing the oval shape improvement body (which reduces the area of the unnecessary portion).

Further, the MultiFan sectional shape of the improvement body reduces a time period of injecting the improving material for each improvement body. Thus, a construction speed becomes higher than that in the prior art, thereby achieving an exceptional effect that the construction time for each improvement body is reduced. That is, the construction period of the j et grouting is reduced. Therefore, according to the present invention, the improvement body having the necessary wall thickness is efficiently constructed. Further, the improvement structure formed of the plurality of improvement bodies is efficiently constructed.

Further, in the present invention, the sectional shape of the MultiFan shape improvement body is formed by a combination of at least two kinds of fan shapes. One of the two kinds of fan shapes corresponds to the small fan shape having the small radius, and the other corresponds to the large fan shape having the large radius.

When constructing the MultiFan shape improvement body as described above, it is preferred that a central angle of the fan shape having the smallest radius is determined based on the effective wall thickness. In addition, it is also preferred that central angles of the fan shapes are determined in ascending order by radius size from the fan shape having the smallest radius. In this manner, the MultiFan shape improvement body having the effective wall thickness can be securely constructed.

Still further, according to the present invention, the rotation speed of the injection rod is stepwisely changed to control the diameter of the MultiFan shape improvement body to be constructed. Through the intermittent change of the rotation speed as described above, control and an apparatus configuration become simpler than those in a case where the rotation speed is continuously changed (specifically, in a case where the oval shape improvement body is constructed). Therefore, increase in size and weight of the jet grouting machine and the equipment therefor can be suppressed to prevent degradation of the construction efficiency. Further, the control and the apparatus configuration are simpler, and hence an existing jet grouting machine can be used for this invention with a simple modification.

Further, according to the present invention, preferably, the improvement body is formed so as to satisfy the condition that its effective wall thickness is 0.7 times the maximum diameter of the improvement body or smaller.

Still further, more preferably, the improvement body is formed so as to satisfy the condition that the minimum diameter of the improvement body is 0.2 times to 0.8 times the maximum diameter.

Still further, more preferably, the improvement body is formed so as to satisfy the condition that a/b is 0.9 or smaller. In this condition, a is a wall thickness coefficient that is obtained by dividing the effective wall thickness by the maximum diameter of the improvement body, and b is a small-diameter coefficient that is obtained by dividing the minimum diameter of the improvement body by the maximum diameter.

Still further, when constructing the improvement body, the small-diameter coefficient b thereof is preferably set so as to satisfy the condition of $a \approx b^2$.

When the improvement body is constructed so as to satisfy the conditions described above, an efficient shape (which has a small unnecessary area/volume with respect to the efficient wall thickness t) is obtained.

Further, according to the present invention, it is preferred that the MultiFan shape improvement body has a shape formed by a combination of two to five kinds of fan shapes having different radiuses. Through construction of the improvement body employing the MultiFan shape described above, the area of the unnecessary portion (volume of the redundant portion exceeding the efficient wall thickness t) is reduced without complication in control of the rotation speed of the injection rod.

Preferably, the MultiFan shape is formed by a combination of three or more kinds of fan shapes having different radiuses. In this manner, an unnecessary area/volume is further reduced.

Further, more preferably, the MultiFan shape is formed by a combination of three to five kinds of fan shapes. The combination of three to five kinds of fan shapes is practically useful and achieves a significant reduction in redundant ratio. Therefore, the most efficient shape (with a small unnecessary area/volume) is achieved.

Further, according to the present invention, the soil breaking state achieved with the improving material injected at high pressure is monitored at the time of forming the improvement body. For example, the monitoring is carried out for each soil layer or each depth. In this manner, at the time of construction of the improvement body, the radiuses of the fan shapes (sectors) forming the sectional shape of the improvement body can be checked, and the effective wall thickness of the improvement body can be checked. As a result, the improvement body and the improvement structure as designed can be constructed.

Further, according to the improvement body and the improvement structure of the present invention, the amount of use of the improving material and the amount of sludge removal can be significantly reduced. Specifically, the amount of injecting the improving material is reduced as compared to the case of constructing the round shape improvement body or the oval shape improvement body. As a result, the material cost and the sludge removal cost (i.e., cost for the disposal of industrial waste) can be significantly reduced.

BRIEF DESCRIPTION OF DRAWINGS

FIG. 1 are views for illustrating improvement bodies according to the present invention in comparison to conventional improvement bodies.

FIG. 2 are views for illustrating an example of a sectional shape of the improvement body constructed according to the present invention. The sectional shape of the improvement body shown in FIG. 2 is formed by a combination of two kinds of fan shapes having different radiuses.

FIG. 3 are views for illustrating an example of a sectional shape of the improvement body constructed according to the present invention. The sectional shape of the improvement body shown in FIG. 3 is formed by a combination of three kinds of fan shapes having different radiuses.

FIG. 4 are views for illustrating an example of a sectional shape of the improvement body constructed according to the present invention. The sectional shape of the improvement body shown in FIG. 4 is formed by a combination of four kinds of fan shapes having different radiuses.

FIG. 5 are views for illustrating an example of a sectional shape of the improvement body constructed according to the present invention. The sectional shape of the improvement body shown in FIG. 5 is formed by a combination of five kinds of fan shapes having different radiuses.

FIG. 6 are views for illustrating improvement structures formed of a plurality of improvement bodies according to the present invention.

FIG. 7 is a graph for showing a change of a rotation speed of an injection rod at the time of construction of the improvement body.

FIG. 8 are plan views for illustrating wall-form structures each of which is an example of the improvement structure of the present invention. FIG. 8(*a*) is an illustration of a wall-form structure formed by arranging a plurality of the improvement bodies in an overlapping manner. Each of the improvement bodies shown in FIG. 8(*a*) is formed by a combination of two kinds of fan shapes corresponding to large and small fan shapes. FIG. 8(*b*) is an illustration of a wall-form structure formed by arranging a plurality of the improvement bodies in an overlapping manner. Each of the improvement bodies shown in FIG. 8(*b*) is formed by a combination of three kinds of fan shapes. FIG. 8(*c*) is an illustration of a wall-form structure constructed so as to have a round shape in plan view. The wall-form structure shown in FIG. 8(*c*) is formed by arranging a plurality of the improvement bodies along a round shape.

FIG. 9 is a plan view for illustrating a planar structure which is an example of the improvement structure according to the present invention. The planar structure is formed by arranging a plurality of the improvement bodies in an overlapping manner. Each of the improvement bodies shown in FIG. 9 is formed by a combination of two kinds of fan shapes corresponding to large and small fan shapes.

FIG. 10 is a view for illustrating a configuration of a monitoring apparatus that is used in the present invention.

FIG. 11 is a table for showing condition settings and results of simulations related to an improvement body having a round shape section (Comparative Example 1).

FIG. 12 is a table for showing condition settings and results of simulations related to an improvement body having an oval shape section (Comparative Example 2).

FIG. 13A is a table for showing condition settings and results of simulations related to an improvement body having a MultiFan shape section (Example).

FIG. 13B is a table for showing condition settings and results of simulations related to an improvement body having a MultiFan shape section (Example).

FIG. 13C is a table for showing condition settings and results of simulations related to an improvement body having a MultiFan shape section (Example).

FIG. 14A is a graph for showing a relationship between a redundant ratio (Ajg-Aw)/Aw and a wall thickness coefficient a (a=t/D1) shown in FIG. 11 to FIG. 13, in which the redundant ratio (Ajg-Aw)/Aw is obtained by dividing a redundant amount (Ajg-Aw) by an effective cross sectional area (Aw) of an improvement body.

FIG. 14B is a graph for showing results related to the round shape improvement body (Comparative Example 1) and the oval shape improvement body (Comparative Example 2), which are extracted from the results shown in FIG. 14A.

FIG. 14C is a graph for showing results related to the round shape improvement body (Comparative Example 1) and the MultiFan shape improvement body (Example), which are extracted from the results shown in FIG. 14A.

FIG. 15 is a graph for showing a relationship between the wall thickness coefficient a (a=t/D1) and a pitch ratio (L/D1) shown in FIG. 11 to FIG. 13.

FIG. 16 is a graph for showing a relationship between the wall thickness coefficient a (a=t/D1) and a number ratio of improvement bodies shown in FIG. 11 to FIG. 13.

FIG. 17 is a graph for showing a relationship between a small-diameter coefficient b (b=D2/D1) and a rate of redundant ratio related to the MultiFan shape improvement body (Example) shown in FIG. 13B and FIG. 13C.

FIG. 18 is a graph for showing a relationship between a/b and the rate of redundant ratio related to the MultiFan shape improvement body (Example) shown in FIG. 13B and FIG. 13C, where a/b is obtained by dividing the wall thickness coefficient a by the small-diameter coefficient b.

FIG. 19 is a graph for showing a relationship between $b^2$ and the rate of redundant ratio related to the MultiFan shape improvement body (Example) shown in FIG. 13B and FIG. 13C, where $b^2$ is obtained by squaring the small-diameter coefficient b.

FIG. 20 are views for illustrating states in steps of ground improvement with a jet grouting method.

FIG. 21 are views for illustrating examples of arrangement of improvement bodies constructed in accordance with the jet grouting method.

FIG. 22 are views for illustrating shapes of improvement bodies constructed in accordance with a conventional jet grouting method.

FIG. 23 is a view for illustrating an improvement body constructed in accordance with the conventional jet grouting method.

FIG. 24 is a graph for showing a change of the rotation speed of the injection rod at the time of construction of the conventional improvement body.

FIG. 25 are views for illustrating the sectional shapes of the improvement bodies constructed in accordance with the conventional jet grouting method.

DESCRIPTION OF EMBODIMENTS

In this application, a ground improvement body (column) having a columnar shape constructed by a jet grouting method is referred to as "improvement body". Further, a ground improvement structure formed of a plurality of improvement bodies constructed in an overlapping arrangement is referred to as "improvement structure".

According to the jet grouting method of the present invention, an improving material (self-hardening material) is injected at high pressure from a nozzle of an injection rod (drill rod), while the injection rod is rotated, to construct the improvement body having a predetermined shape. This construction process is repeated for a plurality of times at different points where improvement bodies have to be constructed, thereby constructing an improvement structure formed of the plurality of improvement bodies. Specific examples of the improvement structure include a wall-form structure described later, a planar structure, a lattice-form structure, and the like.

Further, a sectional shape of each of the improvement bodies that form the improvement structure according to the present invention is a combination of different kinds of fan shapes (sector shapes) having different radiuses. The improvement structure is constructed by the overlapping arrangement of the plurality of improvement bodies described above. The overlapping arrangement is an arrangement in which the adjacent improvement bodies partially overlap with each other as shown in the plan views of FIG. 8.

When constructing improvement bodies forming the improvement structure of the present invention, each improvement body is constructed so as to have a predetermined sectional shape (a predetermined contour shape). The sectional shape (contour shape) of each improvement body is formed by a combination of two or more kinds of fan shapes (sector shapes) having different radiuses, and is formed by combining the fan shapes (sector shapes) at respective central angle portions (central portions) thereof, as shown in FIG. 2 to FIG. 5. In each embodiment shown in FIG. 2(*b*), FIG. 3(*b*), FIG. 4(*b*), and FIG. 5(*b*), a sum of central angles of the fan shapes that form the sectional shape of the improvement body is 360°. Specifically, the combination of the fan shapes with the sum of the central angles being 360° forms the contour shape of the section of the improvement body. Note that, the sum of the central angles is not limited to 360°. As shown in FIG. 6(*a*), an angle smaller than 360° may be selected in accordance with construction conditions. Further, as shown in FIG. 6(*a*), FIG. 6(*b*), and FIG. 6(*c*), the combination of the fan shapes forming the improvement structure is not limited to a point-symmetric shape. The combination of the fan shapes may be designed in accordance with a necessary wall thickness and/or shape.

The sectional shape of the improvement body (entire contour shape formed by a combination of fan shapes having different radiuses) is referred to as "MultiFan shape" in this application. The MultiFan shape represents a shape (contour shape) formed by a combination of two or more kinds of fan shapes (sector shapes) having different radiuses. In this application, the improvement body with the MultiFan sectional shape is referred to as "MultiFan shape improvement body". In the same manner, an improvement body with a round sectional shape is referred to as "round shape improvement body" in this application. Further, an improvement body with an oval sectional shape is referred to as "oval shape improvement body" in this application.

Now, a specific embodiment of the present invention is described with a case where the wall-form improvement structure is constructed through use of the jet grouting method as a specific example.

(Description of Embodiment Illustrated in the Drawings)

In FIG. 1, the improvement bodies to be constructed in this embodiment are illustrated in comparison to the prior arts.

FIG. 1(*a*) and FIG. 1(*b*) are sectional views which are the same as sectional views of FIG. 25, and FIG. 1(*c*) is a sectional view for illustrating the improvement body constructed in this embodiment.

The reference symbols described in FIG. 1 indicate the following sizes.

t: an effective wall thickness which is a minimum thickness required in design of the improvement body D1: a diameter of a round shape improvement body shown in FIG. 1(*a*), a long diameter of an oval shape improvement body shown in FIG. 1(*b*), and a maximum diameter of the MultiFan shape improvement body shown in FIG. 1(*c*)

D2: a short diameter of the oval shape improvement body shown in FIG. 1(*b*), and a minimum diameter of the MultiFan shape improvement body shown in FIG. 1(*c*), L1: a construction pitch (spacing) between round shape improvement bodies of the prior art L2: a construction pitch (spacing) between oval shape improvement bodies of the prior art L3: a construction pitch (spacing) between MultiFan shape improvement bodies of this embodiment.

The embodiment and the prior arts illustrated in FIG. 1 are assumed that the improvement body and the wall-form improvement structure having the effective wall thickness t are constructed on a field with the same conditions. Therefore, the effective wall thickness t is common in FIG. 1(*a*), FIG. 1(*b*), and FIG. 1(*c*).

As shown in FIG. 1, the effective wall thickness t of each improvement body represents a dimension on a short side of a maximum rectangular sectional region included in the improvement body. The effective wall thickness t is a minimum size required for construction of the wall-form improvement structure. The improvement body includes an unnecessary portion (redundant portion) formed outside the effective wall portion with the wall thickness t. The unnecessary portion (redundant portion) of the improvement body does not affect functions of the improvement body/structure, and the functions of the improvement body/structure are not impaired even with the unnecessary portion.

Further, specifications of a jet grouting machine to be used are common to this embodiment and the prior arts illustrated in FIG. 1. It is supposed that a maximum improvement diameter that can be achieved by the jet grouting machine is D1. Therefore, the diameter of the round shape improvement body illustrated in FIG. 1(*a*), the long diameter of the oval shape improvement body illustrated in FIG. 1(*b*), and the maximum diameter of the MultiFan shape improvement body illustrated in FIG. 1(*c*) are all D1.

With regard to the prior art illustrated in FIG. 1(*a*), the left part of FIG. 1(*a*) shows the round shape improvement bodies in the overlapping arrangement, in which the improvement bodies forming the improvement structure are constructed with the predetermined pitch L1 so as to have the effective wall thickness t.

The center part of FIG. 1(*a*) shows a relationship between one of the round shape improvement bodies and a rectangular region (maximum rectangular section) thereof. The rectangular region (maximum rectangular section) secures the effective wall thickness t in the round shape improvement body.

The right part of FIG. 1(*a*) shows a section of the unnecessary portion (redundant portion) of the round shape improvement body, in which the unnecessary portion (redundant portion) is formed outside the effective wall thickness t.

With regard to the prior art illustrated in FIG. 1(*b*), the left part of FIG. 1(*b*) shows the oval shape improvement bodies in the overlapping arrangement, in which the improvement bodies forming the improvement structure are constructed with the effective wall thickness t and the predetermined pitch L2.

The center part of FIG. 1(*b*) shows a relationship between one of the oval shape improvement bodies and a rectangular region (maximum rectangular section) thereof. The rectangular region (maximum rectangular section) secures the effective wall thickness tin the oval shape improvement body. A contour of the "round shape" improvement body constructed through use of the same jet grouting machine is indicated by the broken line. As is apparent from the drawing, when the jet grouting machine having the same specifications is used on the same field, the maximum diameter of the improvement body that can be constructed remains unchanged.

The right part of FIG. 1(*b*) shows a section of the unnecessary portion (redundant portion) of the oval shape improvement body, in which the unnecessary portion (redundant portion) is formed outside the effective wall thickness t. As is apparent from the drawing, apart of the redundant portion is eliminated through change of the sectional shape of the improvement body from the round shape to the oval shape. In the right part of FIG. 1(*b*), the eliminated part of the redundant portion is hatched with lines inclined toward the upper right.

With regard to the embodiment of the present invention illustrated in FIG. 1(*c*), the left part of FIG. 1(*c*) shows the MultiFan shape improvement bodies in the overlapping arrangement, in which the improvement bodies forming the improvement structure are constructed with the effective wall thickness t and the predetermined pitch L3.

The center part of FIG. 1(*c*) shows a relationship between one of the MultiFan shape improvement bodies and a rectangular region (maximum rectangular section) thereof. The rectangular region (maximum rectangular section) secures the effective wall thickness t in the MultiFan shape improvement body. A contour of the "round shape" improvement body constructed through use of the same jet grouting machine is indicated by the broken lines. As is apparent from the drawing, when the jet grouting machine having the same specifications is used on the same field, the maximum diameter of the improvement body that can be constructed remains unchanged.

The right part of FIG. 1(*c*) shows a section of the unnecessary portion (redundant portion) of the MultiFan shape improvement body, in which the unnecessary portion (redundant portion) is formed outside the effective wall thickness t. As is apparent from the drawing, a part of the redundant portion is eliminated through change of the sectional shape of the improvement body from the round shape to the MultiFan shape. In the right part of FIG. 1(*c*), the eliminated part of the redundant portion is hatched with lines inclined toward the upper right.

Further, the MultiFan improvement body constructed in this embodiment is illustrated in FIG. 2. The embodiment illustrated in FIG. 2 corresponds to the embodiment illustrated in FIG. 1(*c*).

FIG. 2(*a*) is a sectional view for illustrating an example of an improvement body having a MultiFan sectional shape.

FIG. 2(*b*) is a view obtained by visualizing the plurality of kinds of fan shapes that form the sectional shape of the improvement body illustrated in FIG. 2(*a*). From this illustration, it is understood that a contour of the sectional shape of the improvement body is formed by a combination of two kinds of fan shapes having different radiuses.

As described above, the MultiFan shape improvement body illustrated in FIG. 2 has a shape formed by the combination of two kinds of fan shapes. One of the kinds of the fan shapes corresponds to the large fan shape having the large radius, and the other kind corresponds to the small fan shape having the small radius. When designing and constructing the MultiFan shape improvement body as illustrated in FIG. 2, it is preferred that the central angle of the fan shape having the smallest radius is determined based on the effective wall thickness t. In addition, it is also preferred that central angles of the fan shapes are determined in ascending order by radius size from the fan shape having the smallest radius. As a result, the MultiFan shape improvement body that satisfies the effective wall thickness is securely constructed.

In FIG. 2(*b*), the contour of each of the fan shapes is clearly illustrated individually for convenience in easy understanding of a configuration of the sectional shape of the MultiFan shape improvement body, and for convenience in easy understanding of a combination pattern of the fan shapes. Note that boundary lines as illustrated in FIG. 2(*b*) (X-like boundary lines in the center of FIG. 2(*b*)) are not formed inside the actual improvement body.

Next, description is made on advantages of this embodiment which are found through comparison between the round shape improvement body illustrated in FIG. 1(*a*) and the MultiFan shape improvement body illustrated in FIG. 1(*c*).

The round shape improvement body illustrated in FIG. 1(*a*) is constructed with the diameter D1. A rectangular region with the wall thickness t and a width L1 is secured inside the section. Specifically, a necessary number of the round shape improvement bodies, each having the diameter D1, are constructed at the pitch L1, and are constructed in the overlapping arrangement so that the adjacent improvement bodies overlap over a predetermined length (D1-L1). As a result, the wall-form improvement structure that satisfies the effective wall thickness t is constructed over a designed length. As illustrated in the right part of FIG. 1(*a*), the unnecessary portion (redundant portion) exceeding the effective wall thickness t is formed inside the round shape improvement body.

Meanwhile, the multiple-fan shape improvement body illustrated in FIG. 1(*c*) is constructed with a maximum diameter D1 and a minimum diameter D2. A rectangular region with the wall thickness t and a width L3 (L3=L1) is secured inside the section of the MultiFan shape improvement body. Specifically, a necessary number of the multiple-fan shape improvement bodies, each having the maximum diameter D1 and the minimum diameter D2, are constructed at the pitch L3, and are constructed in the overlapping arrangement so that the adjacent improvement bodies overlap over a predetermined length (D1-L3). As a result, the wall-form improvement structure having the effective wall thickness t is constructed over a designed length. Also in this embodiment, as illustrated in the right part of FIG. 1(*c*), the unnecessary portion (redundant portion) exceeding the effective wall thickness t is slightly formed in the multiple-fan shape improvement body.

When the round shape improvement body illustrated in FIG. 1(*a*) and the MultiFan shape improvement body illustrated in FIG. 1(*c*) are compared with each other, it is understood that the redundant portion is clearly reduced. In addition, it is understood that a maximum sectional area having the wall thickness t and the width L3 (L3=L1) is secured in the section of the MultiFan shape improvement body, and that the maximum sectional area has the same size as that of the rectangular region secured in the section of the round shape improvement body. Specifically, the pitch of the MultiFan shape improvement bodies to construct the wall-form structure having the necessary wall thickness t is same as that of the round shape improvement bodies to construct the wall-form structure having the necessary wall thickness t (i.e., L3=L1 in FIG. 1). Therefore, the number of improvement bodies to be constructed remains unchanged even when the round shape improvement body is replaced by the MultiFan shape improvement body.

Next, description is made on advantages of this embodiment, which are found through comparison between the oval shape improvement body illustrated in FIG. 1(*b*) and the MultiFan shape improvement body illustrated in FIG. 1(*c*).

The oval shape improvement body illustrated in FIG. 1(*b*) is constructed with a long diameter D1 and a short diameter D2. A rectangular region with the wall thickness t and a width L2 (L2<L1) is secured inside the section. Specifically, a necessary number of the oval shape improvement bodies, each having the long diameter D1 and the short diameter D2, are constructed at the pitch L2, and are constructed in the overlapping arrangement so that the adjacent improvement bodies overlap over a predetermined length (D1-L2). As a result, the wall-form improvement structure having the effective wall thickness t is constructed over a designed length. As illustrated in the right part of FIG. 1(*b*), the unnecessary portion (redundant portion) exceeding the effective wall thickness t is formed inside the oval shape improvement body.

Meanwhile, the MultiFan shape improvement body illustrated in FIG. 1(*c*) is constructed with the maximum diameter D1 and the minimum diameter D2. A rectangular region with the wall thickness t and the width L3 (L3=L1) is secured inside the section of the MultiFan shape improvement body. Specifically, a necessary number of the MultiFan shape improvement bodies, each having the maximum diameter D1 and the minimum diameter D2, are constructed at the pitch L3, and are constructed in the overlapping arrangement so that the adjacent improvement bodies overlap over a predetermined length (D1-L3). As a result, the wall-form improvement structure having the effective wall thickness t is constructed over a designed length. Also in this embodiment, as illustrated in the right part of FIG. 1(*c*), the unnecessary portion (redundant portion) exceeding the effective wall thickness t is slightly formed in the multiple-fan shape improvement body.

As illustrated in FIG. 1(*b*) showing the oval shape improvement body, an area of the maximum rectangular section securing the wall thickness tis " t×L2" in the case of the oval shape improvement body. Meanwhile, as illustrated in FIG. 1(*c*) showing the MultiFan shape improvement body, an area of the maximum rectangular section securing the wall thickness t is "t×L3" (L3>L2 and L3=L1) in the case of the MultiFan shape improvement body. In addition, the rectangular sectional region having the same size as that obtained with the round shape improvement body can be secured inside the MultiFan shape improvement body. Therefore, even when the oval shape improvement body is replaced by the MultiFan shape improvement body, the construction pitch is not narrowed, and thus the number of improvement bodies forming the improvement structure is not increased in the case of the MultiFan shape improvement body. Note that, when the round shape improvement body is replaced by the oval shape improvement body, the construction pitch is narrowed, and thus the number of improvement bodies forming the improvement structure must be increased.

Therefore, from the above-mentioned results of comparison, it is understood that an advantage (wide construction pitch) obtained in the case of the construction of the round shape improvement body and an advantage (reduction in area (volume) of the unnecessary portion) obtained in the case of the construction of the oval shape improvement body can be both achieved according to the present invention.

In the above-mentioned embodiment, the sectional shape of the improvement body of the present invention is formed by the combination of two kinds of fan shapes, in which one of the kinds of the fan shapes corresponds to the large fan shape having the large radius, and the other kind corresponds to the small fan shape having the small radius. However, the MultiFan shape improvement body according to the present invention is not limited thereto, and another embodiments of the MultiFan improvement body are illustrated in FIG. 3 to FIG. 5.

FIG. 3(*a*) is a sectional view for illustrating another example of the improvement body having a MultiFan sectional shape.

FIG. 3(*b*) is a view obtained by visualizing the plurality of kinds of fan shapes that form the sectional shape of the improvement body illustrated in FIG. 3(*a*). From this illustration, it is understood that a contour of the sectional shape of the improvement body is formed by a combination of three kinds of fan shapes having different radiuses.

As illustrated in FIG. 3(*b*), in the improvement body to be constructed in this embodiment, a pair of fan shapes with the smallest radius (which are illustrated at the center in FIG. 3(*b*)) are arranged in a thickness direction of the wall thickness t. Further, the three kinds of fan shapes are arranged so that the radiuses sequentially increase from the "the pair of fan shapes with the smallest radius" as a base point in a longitudinal direction of an effective wall portion (rectangular sectional region) of the improvement body. The longitudinal direction of the effective wall portion corresponds to a direction perpendicular to the wall thickness t in FIG. 3.

FIG. 4(*a*) is a sectional view for illustrating another example of the improvement body having a MultiFan sectional shape.

FIG. 4(*b*) is a view obtained by visualizing the plurality of kinds of fan shapes that form the sectional shape of the improvement body illustrated in FIG. 4(*a*). From this illustration, it is understood that a contour of the sectional shape of the improvement body is formed by a combination of four kinds of fan shapes having different radiuses.

As illustrated in FIG. 4(*b*), in the improvement body to be constructed in this embodiment, a pair of fan shapes with the smallest radius (which are illustrated at the center in FIG. 4(*b*)) are arranged in a thickness direction of the wall thickness t. Further, the four kinds of fan shapes are arranged so that the radiuses sequentially increase from the "the pair of fan shapes with the smallest radius" as a base point in a longitudinal direction of an effective wall portion (rectangular sectional region) of the improvement body. The longitudinal direction of the effective wall portion corresponds to a direction perpendicular to the wall thickness t in FIG. 4.

FIG. 5(*a*) is a sectional view for illustrating another example of the improvement body having a MultiFan sectional shape.

FIG. 5(*b*) is a view obtained by visualizing the plurality of kinds of fan shapes that form the sectional shape of the improvement body illustrated in FIG. 5(*a*). From this illustration, it is understood that a contour of the sectional shape of the improvement body is formed by a combination of five kinds of fan shapes having different radiuses.

As illustrated in FIG. 5(*b*), in the improvement body to be constructed in this embodiment, a pair of fan shapes with the smallest radius (which are illustrated at the center in FIG. 5(*b*)) are arranged in a thickness direction of the wall thickness t. Further, the five kinds of fan shapes are arranged so that the radiuses sequentially increase from the "the pair of fan shapes with the smallest radius" as a base point in a longitudinal direction of an effective wall portion (rectangular sectional region) of the improvement body. The longitudinal direction of the effective wall portion corresponds to a direction perpendicular to the wall thickness t in FIG. 5.

In FIG. 2(*b*), FIG. 3(*b*), FIG. 4(*b*), and FIG. 5(*b*), the contour of each of the fan shapes is clearly illustrated individually for convenience in easy understanding of the configuration of the sectional shape of the MultiFan shape improvement body, and for convenience in easy understanding of a combination pattern of the fan shapes. Note that the boundary lines illustrated in the drawings described above are not formed inside the actual improvement body.

Further, the MultiFan shape improvement bodies according to the present invention are shown in FIG. 2 to FIG. 5. Preferably, the MultiFan shape is formed by a combination of three or more kinds of fan shapes having different radiuses. As a result, the unnecessary area (volume) is further reduced. However, although the unnecessary area is reduced as the number of kinds of fan shapes increases, more detailed control is required. Therefore, more preferably, the MultiFan shape is formed by a combination of three to five kinds of fan shapes. A practically useful and most efficient shape (with a reduced unnecessary area/volume) is obtained when three to five kinds of fan shapes are combined.

(Construction of Improvement Body)

A construction process with the jet grouting method that has hitherto been carried out is as described above with reference to FIG. 20. When the round shape improvement body (prior art) is to be constructed according to the jet grouting method, a rotation speed of the injection rod (injection tube) is constant as shown in FIG. 7. Further, when the oval shape improvement body (prior art) is to be constructed, the rotation speed of the injection rod is continuously changed. More specifically, the rotation speed of the injection rod is continuously changed so as to draw a curve (i.e., sine curve) as shown in FIG. 7. Specifically, the rotation speed of the injection rod changes continuously in a non-step manner.

Meanwhile, when the MultiFan shape improvement body according to this embodiment is to be constructed, the rotation speed (rotation number) of the injection rod is changed intermittently. More specifically, the rotation speed is changed stepwisely so as to draw a square wave as shown in FIG. 7, thereby controlling the diameter of improvement body to be constructed so as to have a MultiFan sectional shape. The term "stepwisely" herein represents, in other words, a step-like change of the rotation speed or an intermittent change of the rotation speed in a plurality of steps.

For example, when constructing the MultiFan shape improvement body whose sectional shape is the combination of two kinds of fan shapes (i.e., large and small fan shapes) as shown in FIG. 2, the rotation speed of the injection rod is changed stepwisely in two steps between minimum speed (low speed) and maximum speed (high speed) as shown in FIG. 7. Similarly, when constructing the MultiFan shape improvement body whose sectional shape is the combination of three kinds of fan shapes as shown in FIG. 3, the rotation speed of the injection rod is changed stepwisely in three steps. When constructing the MultiFan shape improvement body whose sectional shape is the combination of four kinds of fan shapes as shown in FIG. 4, the rotation speed of the injection rod is changed stepwisely in four steps. When constructing the MultiFan shape improvement body whose sectional shape is the combination of five kinds of fan shapes as shown in FIG. 5, the rotation speed of the injection rod is changed stepwisely in five steps.

When the MultiFan shape improvement body is constructed according to the present invention, the improving material is injected at high pressure from an injection nozzle mounted at a bottom end of the injection rod while the injection rod is being rotated. Specifically, under a state in which the injection rod is rotated continuously (however, the rotation speed of the injection rod changes stepwisely), the improving material is injected at high pressure. Therefore, when the improving material is injected at high pressure, the injection rod is continuously rotated. As described above, through injecting of the improving material at high pressure while the injection rod is rotated, the improving material is mixed three-dimensionally with the in-situ soil within a reachable range of the injected improving material. As a result, there is achieved a remarkable effect in that a uniform improvement body formed of a mixture of the in-situ soil and the improving material is efficiently constructed.

Through construction of the plurality of MultiFan shape improvement bodies in the overlapping arrangement so as to be linearly continuous in plan view by the above-mentioned method, the wall-form structure formed of the plurality of MultiFan shape improvement bodies as shown in plan views of FIG. 8(*a*), FIG. 8(*b*), and FIG. 8(*c*) is constructed. The applicable range of the present invention is not limited to the construction of the wall-form structure as illustrated in FIG. 8. The present invention is applicable to the construction of any structure formed of the plurality of improvement bodies. For example, the present invention is applicable to construction of a planar-arrangement structure as illustrated in FIG. 9. The planar-arrangement structure illustrated in FIG. 9 is constructed by forming the plurality of MultiFan shape improvement bodies in the overlapping arrangement so as to be continuous in a planar manner in plan view.

(Monitoring of Jet Flow of Improving Material)

In the jet grouting method according to the present invention, a soil breaking is made by a jet flow of the improving material injected from the nozzle of the injection rod in the ground. It is preferred to check a state (length) of the soil breaking achieved by the jet flow of the improving material in real time so as to control the improvement diameter (i.e., the diameter of the improvement body to be constructed). For example, a monitoring apparatus 1 as illustrated in FIG. 10 is used for a test construction in the jet grouting to control the improvement diameter.

In the test construction, the in-situ soil is broken up and loosened by the improving material injected at high pressure from the injection rod, while monitoring the jet flow of the improving material that breaks up the in-situ soil. Depending on the jet flow of the improving material monitored by the monitoring apparatus 1, the rotation speed (rotation number) of the injection rod injecting the improving material is adjusted in real time to be set to an optimal value, thereby securing a desired improvement diameter.

In order to monitor the jet flow described above in real time when constructing the improving body, the monitoring apparatus 1 illustrated in FIG. 10 is used. FIG. 10 shows a state of the overall test construction where the monitoring apparatus 1 is used.

As illustrated in FIG. 10, the monitoring apparatus 1 includes:

a lower-limit detection tube 24 for detecting lower limit of a diameter of the in-situ soil broken by the jet flow of the injected improving material, which is inserted into a drilled hole and in which a lower-limit detection sensor 21 is provided;

an upper-limit detection tube 34 for detecting upper limit of a diameter of the in-situ soil broken by the jet flow of the injected improving material, which is inserted into a drilled hole and in which an upper-limit detection sensor 31 is provided;

suspension cables 22 and 32 configured to suspend the detection sensors 21 and 31 inside the detection tubes 24 and 34, respectively;

hoisting machines 25 and 35 configured to raise and lower the detection sensors 21 and 31 through the suspension cables 22 and 32; and a processing unit 4 configured to record data obtained by the detection sensors 21 and 31 and to perform information processing through use of the data.

The suspension cables 22 and 32 serve to suspend the detection sensors 21 and 31 provided inside the detection tubes 24 and 34, respectively. The suspension cables 22 and 32 are mounted to the hoisting machines 25 and 35 installed on a ground surface side so as to be able to be reeled up and out. Through actuation of the hoisting machines 25 and 35 along with lowering and raising of the injection rod 7, the detection sensors 21 and 31 in the detection tubes 24 and 34 can be raised and lowered so as to follow the injection rod 7.

In the test construction process through use of the monitoring apparatus 1, two vertical holes are drilled at points corresponding to a lower limit value (minimum allowable diameter) and an upper limit value (maximum allowable diameter) in the allowable range of designed improvement diameter. That is, the vertical holes are drilled at points corresponding to a lower limit and an upper limit of a designed improvement diameter. In the embodiment illustrated in FIG. 10, the vertical holes are drilled at a point at a distance $r_A$ and at a point at a distance $r_B$ from a central axis of the improved body to be constructed. Then, the detection tubes 24 and 34 are inserted into the respective drilled holes. The detection sensors 21 and 31 are configured so as to detect the jet flow of the improving material that is now breaking up the in-situ soil, and they are provided inside the detection tubes 24 and 34, respectively.

Subsequently, the test construction is started. In the course of the test construction, the jet flow of the improving material breaking up the in-situ soil is monitored using a set of the detection sensors 21 and 31 for each soil layer or each depth. Then, as a specification for each soil layer or each depth, the rotation speed (rotation number) of the injection rod 7 is adjusted so that the jet flow of the improving material is detectable by the lower-limit detection sensor 21 and so that the jet flow is undetectable by the upper-limit detection sensor 31.

In this embodiment, the jet flow of the improving material is monitored for one monitoring point each time the injection rod 7 injecting the improving material makes one rotation. In order to monitor the jet flow for one monitoring point, a set of the detection tubes 24 and 34 having the detection sensors 21 and 31 is arranged at the predetermined monitoring point. Specifically, the lower-limit detection tube 24 having the detection sensors 21 is arranged at a detection point at the distance $r_A$ from the center of the improvement body to be constructed, and the upper-limit detection tube 34 having the detection sensors 31 are arranged at a detection point at the distance $r_B$ from the center thereof. The number of points where the monitoring is to be carried out is not limited to one. The monitoring may be carried out for a plurality of monitoring points each time the injection rod 7 injecting the improving material makes one rotation. When the monitoring is carried out for the plurality of monitoring points, a plurality of sets of the detection tubes each having a detection sensor are respectively arranged at monitoring points where the monitoring is required.

EXAMPLE

Next, a specific example of the present invention is described.

With assumption that the same jet grouting machine was used on the same field, simulations for constructing different types of improvement bodies having different sectional shape and a wall-form improvement structure were carried out. In the simulations, effects were examined for Comparative Examples and Example shown in Table 1.

TABLE 1

| | |
|---|---|
| Comparative Example 1 | Improvement body having round sectional shape as shown in FIG. 1(a) |
| Comparative Example 2 | Improvement body having oval sectional shape as shown in FIG. 1(b) |
| Example | Improvement body having MultiFan sectional shape as shown in FIG. 1(c) (Improvement body having sectional shape which is combination of two kinds of fan shapes corresponding to small and large fan shapes) |

Detailed condition settings and results of the simulations are as shown in FIG. 11 to FIG. 13.

In FIG. 11, the condition settings and the results of simulations for the round shape improvement body (Comparative Example 1) are shown.

In the simulations for the round shape improvement body (Comparative Example 1), a variety of conditions were set for the effective wall thickness t, while the value of the diameter D1 was fixed to 1. Further, a redundant ratio, a pitch ratio, and an improvement body number ratio derived from the simulation were obtained as the results of simulations.

In FIG. 12, the condition settings and the results of simulations for the oval shape improvement body (Comparative Example 2) are shown.

In the simulations for the oval shape improvement body (Comparative Example 2), a variety of conditions were set for the short diameter D2 and the effective wall thickness t, while the value of the long diameter D1 was fixed to 1. Further, a redundant ratio, a pitch ratio, and an improvement body number ratio derived from the simulations were obtained as the results of simulations.

In FIG. 13, the condition settings and the results of simulations for the MultiFan shape improvement body (Example) are shown.

In the simulations for the MultiFan shape improvement body (Example), a variety of conditions were set for the short diameter D2 and the effective wall thickness t, while the value of the large diameter D1 was fixed to 1. Further, a redundant ratio, a redundant ratio rate, a pitch ratio, and an improvement body number ratio derived from the simulation were obtained as the results of simulations.

(Results of Simulations)

In the results of simulations shown in FIG. 11 to FIG. 13, key points in the examination of the effects of the present invention are graphically depicted in FIG. 14 to FIG. 19.

FIG. 14A is a graph for showing a relationship between the redundant ratio (Ajg-Aw)/Aw and a wall thickness coefficient a (a=t/D1) shown in FIG. 11 to FIG. 13, in which the redundant ratio (Ajg-Aw /Awis obtained by dividing a redundant amount (Ajg-Aw) by an effective cross sectional area (Aw) of an improvement body.

FIG. 14B is a graph for showing the results related to the round shape improvement body (Comparative Example 1) and the oval shape improvement body (Comparative Example 2), which are extracted from the results shown in FIG. 14A.

FIG. 14C is a graph for showing the results related to the round shape improvement body (Comparative Example 1) and the MultiFan shape improvement body (Example), which are extracted from the results shown in FIG. 14A.

FIG. 15 is a graph for showing a relationship between the wall thickness coefficient a (a=t/D1) and the pitch ratio (L/D1) shown in FIG. 11 to FIG. 13.

FIG. 16 is a graph for showing a relationship between the wall thickness coefficient a (a=t/D1) and a number ratio of improvement bodies shown in FIG. 11 to FIG. 13. The "number ratio of improvement bodies" is a ratio given on the basis of the round shape improvement body (Comparative Example 1), and indicates a ratio of increase/decrease of the number of improvement bodies constructed in a predetermined field.

FIG. 17 is a graph for showing a relationship between a small-diameter coefficient b (b=D2/D1) and the rate of redundant ratio related to the MultiFan shape improvement body (Example) shown in FIG. 13. The "rate of redundant ratio" is a rate given on the basis of the redundant ratio of the round shape improvement body (Comparative Example 1).

FIG. 18 is a graph for showing a relationship between a/b and the rate of redundant ratio related to the MultiFan shape improvement body (Example) shown in FIG. 13, where a/b is obtained by dividing the wall thickness coefficient a by the small-diameter coefficient b.

FIG. 19 is a graph for showing a relationship between $b^2$ and the rate of redundant ratio related to the MultiFan shape improvement body (Example) shown in FIG. 13, where $b^2$ is obtained by squaring the small-diameter coefficient b.

(Observation Based on FIG. 14 to FIG. 19)

According to the results of simulations shown in FIG. 14A to FIG. 14C, through construction of the MultiFan shape improvement body, it was verified that the redundant ratio that was much lower than that of the round shape improvement body was successfully achieved. Further, it was also verified that the low redundant ratio that was equivalent to redundant ratio of the oval shape improvement body was successfully achieved.

In particular, it was verified that the lower redundant ratio was successfully achieved by constructing the MultiFan shape improvement body so that the effective wall thickness t of the wall-form improvement structure was 0.7 times the maximum diameter D1 of each MultiFan shape improvement body or smaller. In addition, it was also verified that the MultiFan shape improvement body was efficiently constructed.

According to the results of simulations shown in FIG. 15 and FIG. 16, it was verified that, when the plurality of improvement bodies were constructed within the same range on the same field, the construction pitch was unchanged and therefore the number of constructed improvement bodies was unchanged even with selection of any of the round shape improvement body and the MultiFan shape improvement body. Meanwhile, it was verified that, when the oval shape improvement body was constructed, the construction pitch was narrowed to increase the number of constructed improvement bodies as compared to the round shape improvement body and the MultiFan shape improvement body.

Therefore, it was found that, with the MultiFan shape improvement body according to the present invention, the redundant ratio lower than that of the round shape improvement body was successfully achieved, and that the same construction pitch as that of the round shape improvement body was successfully kept (i.e., the number of constructed improvement bodies was unchanged).

According to the results of simulations shown in FIG. 17, it was verified that the "rate of redundant ratio" of the constructed improvement body was effectively reduced, and that the improvement body was efficiently constructed, when forming the improvement body so as to satisfy the condition that the minimum diameter thereof is 0.2 times to 0.8 times the maximum diameter.

According to the results of simulations shown in FIG. 18, it was verified that reduction in the rate of redundant ratio was observed, and that the MultiFan shape improvement body was efficiently constructed, when forming the improvement body so as to satisfy the condition that a/b was 0.9 or smaller. In this condition, a and b are given as follows.

a: wall thickness coefficient (which is obtained by dividing the effective wall thickness by the maximum diameter of the improvement body.)

b: small-diameter coefficient (which is obtained by dividing the minimum diameter of the improvement body by the maximum diameter.)

According to the results of simulations shown in FIG. 19, it was verified that the smallest rate of redundant ratio was achieved with respect to the wall thickness coefficient a, and that the MultiFan shape improvement body was efficiently constructed, when forming the improvement body so as to satisfy the condition of $a \approx b^2$. In this condition, b is given as follows.

b: small-diameter coefficient (which is obtained by dividing the minimum diameter of the improvement body by the maximum diameter.)

REFERENCE SIGNS LIST

1 monitoring apparatus
4 information processing unit
5 jet flow of improving material
6 jet grouting machine
7 injection rod (drill rod)
21 lower-limit detection sensor
22 suspension cable
24 lower-limit detection tube
25 hoisting machine
31 upper-limit detection sensor
32 suspension cable
34 upper-limit detection tube
35 hoisting machine

The invention claimed is:

1. A jet grouting method for improving a ground to be treated, the method comprising:

forming a ground improvement body by injecting an improving material into the ground from a nozzle of an injection rod while rotating the injection rod in the ground, the ground improvement body having a sectional shape which is a combination of different kinds of fan shapes having different radiuses, the ground improvement body being formed so as to have an effective wall thickness that is required in design thereof, wherein the sectional shape of the ground improvement body is a combination of at least two kinds of fan shapes, one of the kinds corresponding to a fan shape having a smaller radius, and the other corresponding to a fan shape having a larger radius, wherein, when forming the ground improvement body, a rotation speed of the injection rod injecting the improving material from the nozzle is changed stepwisely to control a diameter of the ground improvement body to be formed, wherein the different kinds of fan shapes are arranged so that radiuses thereof sequentially increase in a longitudinal direction of the effective wall thickness while fan shapes having the smallest radius are arranged in a direction of the effective wall thickness, and wherein the ground improvement body is formed so that:

the effective wall thickness is 0.7 times a maximum diameter of the ground improvement body or smaller, the minimum diameter of the ground improvement body is 0.2 times to 0.8 times the maximum diameter thereof, and a/b is 0.9 or smaller, where a is a wall thickness coefficient that is obtained by dividing the effective wall thickness by the maximum diameter of the improvement body, and where b is a small-diameter coefficient that is obtained by dividing the minimum diameter of the improvement body by the maximum diameter.

2. A jet grouting method according to claim 1, wherein the ground improvement body is formed so that the small-diameter coefficient b thereof satisfies the condition of $a \approx b^2$, wherein a central angle of the fan shape having the smallest radius is determined with respect to the effective wall thickness, and wherein central angles of the fan shapes are determined in ascending order from the fan shape having the smallest radius.

3. A jet grouting method according to claim 1, wherein the sectional shape of the ground improvement body is a combination of two to five kinds of fan shapes having different radiuses.

4. A jet grouting method according to claim 1, wherein a jet flow of the improving material injected via the injection rod breaks up and loosens in-situ soil, and wherein the method further comprises:

monitoring the jet flow of the improving material using a lower-limit detection sensor and an upper-limit detection sensor, the lower-limit detection sensor being provided in a lower-limit detection tube inserted into a drilled hole, the upper-limit detection sensor being provided in an upper-limit detection tube inserted into a drilled hole, and adjusting the rotation speed of the injection rod injecting the improving material so that the jet flow thereof is detectable by the lower-limit detection sensor and so that the jet flow is undetectable by the upper-limit detection sensor.

5. A jet grouting method according to claim 1, wherein a plurality of ground improvement bodies are formed to construct a ground improvement structure including the plurality of ground improvement bodies.

* * * * *